US009702233B2

(12) United States Patent
Stahl et al.

(10) Patent No.: US 9,702,233 B2
(45) Date of Patent: Jul. 11, 2017

(54) IN SITU HYDROCARBON RECOVERY USING DISTRIBUTED FLOW CONTROL DEVICES FOR ENHANCING TEMPERATURE CONFORMANCE

(71) Applicant: Suncor Energy Inc., Calgary (CA)

(72) Inventors: Richard Stahl, Calgary (CA); Jennifer Smith, Calgary (CA)

(73) Assignee: Suncor Energy Inc., Calgary (Alberta) (CA)

( * ) Notice: Subject to any disclaimer, the term of this patent is extended or adjusted under 35 U.S.C. 154(b) by 450 days.

(21) Appl. No.: 14/296,971

(22) Filed: Jun. 5, 2014

(65) Prior Publication Data

US 2015/0354330 A1 Dec. 10, 2015

(30) Foreign Application Priority Data

May 30, 2014 (CA) ..... 2853074

(51) Int. Cl.
*E21B 43/14* (2006.01)
*E21B 43/24* (2006.01)

(52) U.S. Cl.
CPC ..... *E21B 43/14* (2013.01); *E21B 43/2406* (2013.01)

(58) Field of Classification Search
CPC ... E21B 43/14; E21B 43/2406; E21B 43/2408
See application file for complete search history.

(56) References Cited

U.S. PATENT DOCUMENTS

2005/0072567 A1* 4/2005 Steele ..... E21B 43/2408 166/272.3
2005/0072578 A1* 4/2005 Steele ..... E21B 34/08 166/386

(Continued)

FOREIGN PATENT DOCUMENTS

CA 2834808 12/2012
CA 2853074 A1 * 11/2015 ..... E21B 43/2406

(Continued)

OTHER PUBLICATIONS

John L. Stalder (ConocoPhillips), "Test of SAGD Flow Distribution Control Liner System, Surmont Field, Alberta, Canada", Society of Petroleum Engineers, SPE Wester Regional Meeting, Bakersfied, California, USA, SPE 153706, 9 pages, Mar. 2012.

*Primary Examiner* — Jennifer H Gay
(74) *Attorney, Agent, or Firm* — Brinks Gilson & Lione

(57) ABSTRACT

Hydrocarbon recovery can involve operating flow control devices distributed along a horizontal well based on temperatures of hydrocarbon-containing fluids at a plurality of locations along the horizontal well. The temperatures of hydrocarbon-containing fluids can indicate a presence of a hotter overlying reservoir region and an adjacent colder overlying reservoir region. The operation of the distributed flow control devices can involve reducing flow of hydrocarbon-containing fluid from the hotter overlying reservoir region into the horizontal well, while providing fluid communication and pressure differential between the colder overlying reservoir region and the production well, sufficiently to cause hot fluids surrounding the colder overlying reservoir region to be drawn into and induce heating of the colder overlying reservoir region.

39 Claims, 11 Drawing Sheets

(56) References Cited

U.S. PATENT DOCUMENTS

| | | | | |
|---|---|---|---|---|
| 2010/0096126 | A1* | 4/2010 | Sullivan | E21B 43/168<br>166/260 |
| 2012/0145388 | A1* | 6/2012 | Bunio | E21B 43/20<br>166/275 |
| 2012/0241150 | A1* | 9/2012 | Al Yahyai | E21B 43/14<br>166/270 |
| 2013/0032336 | A1* | 2/2013 | Abbate | E21B 43/24<br>166/250.01 |
| 2013/0327525 | A1* | 12/2013 | Yang | E21B 43/2406<br>166/272.3 |
| 2014/0166280 | A1* | 6/2014 | Stone | E21B 43/12<br>166/268 |
| 2014/0262220 | A1* | 9/2014 | Guerrero | E21B 47/00<br>166/245 |
| 2015/0354330 | A1* | 12/2015 | Stahl | E21B 43/2406<br>166/254.1 |

FOREIGN PATENT DOCUMENTS

| | | | |
|---|---|---|---|
| WO | WO 2011/098328 | A2 | 8/2011 |
| WO | WO 2013/025420 | A2 | 2/2013 |
| WO | WO 2013/124744 | A2 | 8/2013 |

* cited by examiner

IN SITU HYDROCARBON RECOVERY USING DISTRIBUTED FLOW CONTROL DEVICES FOR ENHANCING TEMPERATURE CONFORMANCE

PRIORITY CLAIM

This application claims priority to Canadian Application No. 2,853,074, filed May 30, 2014, entitled "IN SITU HYDROCARBON RECOVERY USING DISTRIBUTED FLOW CONTROL DEVICES FOR ENHANCING TEMPERATURE CONFORMANCE," and which is incorporated by reference herein in its entirety.

TECHNICAL FIELD

The general technical field relates to in situ hydrocarbon recovery and, in particular, to various techniques for recovering hydrocarbons, such as heavy hydrocarbons or bitumen, involving selective operation of distributed flow control devices to promote temperature and production conformance.

BACKGROUND

There are a number of in situ techniques for recovering hydrocarbons, such as heavy oil and bitumen, from subsurface reservoirs. Thermal in situ recovery techniques often involve the injection of a heating fluid, such as steam, in order to heat and thereby reduce the viscosity of the hydrocarbons to facilitate recovery.

One technique, called Steam-Assisted Gravity Drainage (SAGD), has become a widespread process for recovering heavy oil and bitumen particularly in the oil sands of northern Alberta. The SAGD process involves well pairs, each pair having two horizontal wells drilled in the reservoir and aligned in spaced relation one on top of the other. The upper horizontal well is a steam injection well and the lower horizontal well is a production well.

Numerous wells or well pairs are usually provided in groups extending from central pads for hundreds of meters often in parallel relation to one another in order to recover hydrocarbons from a reservoir.

For such thermal in situ recovery operations utilizing steam injection, a steam chamber is formed and tends to grow upward and outward within the reservoir, heating the bitumen or heavy hydrocarbons sufficiently to reduce the viscosity and allow the hydrocarbons and condensed water to flow downward toward the production well. However, heating the reservoir and controlling the flow of hydrocarbon-containing fluids along the production well present a number of challenges.

For example, inflow distribution can be biased toward one or more sections of the production well, which can lead to poor temperature conformance, reduced production rates, and uneven drawdown distribution along the production well. Additionally, avoidance of steam breakthrough by maintaining an optimal steam-fluid interface between the well pair involves a proper control of the amount of fluid being drawn into the production well. In some instances, distributed flow control devices have been provided in well completion designs, in an attempt to ensure that the steam chamber extends as close as possible to the production well but not so close as to cause steam breakthrough.

Accordingly, various challenges still exist in the field of thermal in situ hydrocarbon recovery, inflow distribution and steam breakthrough control, and well conformance management.

SUMMARY

In some implementations, there is provided a process for hydrocarbon recovery, including:

- providing a Steam-Assisted Gravity Drainage (SAGD) well pair in a hydrocarbon-containing reservoir, the well pair including a generally horizontal SAGD injection well overlying a generally horizontal SAGD production well;
- identifying a hotter overlying reservoir region and an adjacent colder overlying reservoir region based on measured temperatures of hydrocarbon-containing fluids at a plurality of locations along the horizontal SAGD production well obtained using a plurality of temperature sensors; and
- operating flow control devices distributed along the horizontal SAGD production well based on the measured temperatures of the hydrocarbon-containing fluids, the operating including:
  - reducing flow of hydrocarbon-containing fluid from the hotter overlying reservoir region into the horizontal SAGD production well, while
  - providing fluid communication and pressure differential between the colder overlying reservoir region and the horizontal SAGD production well, sufficiently to cause hot fluids surrounding the colder overlying reservoir region to be drawn into and induce heating of the colder overlying reservoir region.

In some implementations, the hotter overlying reservoir region is located above a toe of the horizontal SAGD production well.

In some implementations, the hotter overlying reservoir region is located above a heel of the horizontal SAGD production well.

In some implementations, the process further includes:

- partitioning the horizontal SAGD production well into well segments, each well segment being associated with at least one of the flow control devices.

In some implementations, the step of partitioning the horizontal SAGD production well into well segments includes providing isolation devices positioned along the horizontal SAGD production well.

In some implementations, the step of operating the flow control devices further includes:

- reducing flow of hydrocarbon-containing fluid from the hotter overlying reservoir region into at least one well segment located below the hotter overlying reservoir region, while
- providing fluid communication and pressure differential between at least one well segment located below the colder overlying reservoir region and the horizontal SAGD production well.

In some implementations, each isolation device is located between two adjacent ones of the flow control devices.

In some implementations, the well segments include at least three well segments.

In some implementations, the well segments consist of four well segments.

In some implementations, each well segment has a length of between about 10 and about 500 meters.

In some implementations, the plurality of temperature sensors includes a plurality of distributed fiber-optic temperature sensors positioned along the horizontal SAGD production well.

In some implementations, the flow control devices include hydraulically actuated valves.

In some implementations, the step of operating the flow control devices further includes:

reducing flow of hydrocarbon-containing fluid from the hotter overlying reservoir region when the hydrocarbon-containing fluid from the hotter overlying reservoir region reaches an upper threshold temperature;

allowing the hydrocarbon-containing fluid from the hotter overlying reservoir region to cool to a lower threshold temperature; and then increasing flow of the hydrocarbon-containing fluid from the hotter overlying reservoir region.

In some implementations, the upper threshold temperature and the lower threshold temperature are based on a targeted upper sub-cool temperature and a targeted lower sub-cool temperature, respectively.

In some implementations, the targeted upper sub-cool temperature is between about 1 and about 5 degrees Celsius.

In some implementations, the targeted lower sub-cool temperature is between about 25 and about 50 degrees Celsius.

In some implementations, the upper threshold temperature is lower than a temperature of steam injected into the horizontal SAGD injection well.

In some implementations, the step of providing fluid communication and pressure differential between the colder overlying reservoir region and the horizontal SAGD production well is performed at a first pressure drawdown, and the step of increasing the flow of the hydrocarbon-containing fluid from the hotter overlying reservoir region is performed at a second pressure drawdown lower than the first pressure drawdown.

In some implementations, the step of operating the flow control devices includes operating the flow control devices located below the colder overlying reservoir region in an open position.

In some implementations, the step of operating the flow control devices includes impeding flow from the hotter overlying reservoir region into the horizontal SAGD production well while enabling a lower flow rate.

In some implementations, the step of operating the flow control devices includes stopping flow from the hotter overlying reservoir region into the horizontal SAGD production well.

In some implementations, the step of stopping the flow includes operating the corresponding flow control devices in a closed position.

In some implementations, the step of operating the flow control devices further includes:

maintaining a reduced flow of hydrocarbon-containing fluid from the hotter overlying reservoir region into the horizontal SAGD production well until a level of hydrocarbon-containing fluid in the hotter overlying reservoir region reaches an upper threshold level; and then increasing flow of the hydrocarbon-containing fluid from the hotter overlying reservoir region.

In some implementations, the step of operating the flow control devices further includes:

maintaining a reduced flow of hydrocarbon-containing fluid from the hotter overlying reservoir region into the horizontal SAGD production well until an average of the measured temperatures along the colder overlying reservoir region reaches an upper threshold value; and then increasing flow of the hydrocarbon-containing fluid from the hotter overlying reservoir region.

In some implementations, the step of operating the flow control devices further includes:

maintaining a reduced flow of hydrocarbon-containing fluid from the hotter overlying reservoir region into the horizontal SAGD production well until a variance of the measured temperatures along the horizontal SAGD production well relative to a maximum measured temperature reaches a lower threshold variance, such that the hotter and colder overlying reservoir regions together form an overlying conformance reservoir region; and then increasing flow of the hydrocarbon-containing fluid from the former hotter overlying reservoir region.

In some implementations, the process further includes:

monitoring the temperatures from the overlying conformance reservoir region to identify any additional temperature variations in the measured temperatures, to identify formation of a re-formed hotter overlying reservoir region and a re-formed adjacent colder overlying reservoir region; and operating the flow control devices in order to reduce flow of hydrocarbon-containing fluid from the re-formed hotter overlying reservoir region into the horizontal SAGD production well while providing fluid communication and pressure differential between the re-formed colder overlying reservoir region and the horizontal SAGD production well, thereby causing hot fluids surrounding the re-formed colder overlying reservoir region to be drawn into and induce heating of the re-formed colder overlying reservoir region.

In some implementations, the process further includes:

identifying at least one further hot overlying reservoir region and reducing flow of hydrocarbon-containing fluid from the further hot overlying reservoir region into the horizontal SAGD production well; and/or identifying at least one further cold overlying reservoir region and providing fluid communication and pressure differential between the further cold overlying reservoir region and the horizontal SAGD production well.

In some implementations, the step of operating the flow control devices further includes reducing flow of hydrocarbon-containing fluid into the flow control device located below the overlying colder reservoir region that is closest to the overlying hotter reservoir once the hydrocarbon-containing fluids at the flow control device closest to the overlying hotter reservoir reach an upper fluid temperature.

In some implementations, the step of operating the flow control devices further includes sequentially reducing flow of hydrocarbon-containing fluid through a series of flow control devices located below the colder overlying reservoir region, starting from the flow control device proximate the hotter overlying reservoir region, once the hydrocarbon-containing fluids at each flow control device in the series sequentially reach an upper fluid temperature.

In some implementations, there is provided a process for hydrocarbon recovery using a generally horizontal well located in a hydrocarbon-containing reservoir, including:

operating flow control devices distributed along the horizontal well based on temperatures of hydrocarbon-containing fluids at a plurality of locations along the horizontal well, the temperatures of hydrocarbon-containing fluids indicating a presence of a hotter overlying reservoir region and an adjacent colder overlying reservoir region in the hydrocarbon-containing reservoir, the operating including:

reducing flow of hydrocarbon-containing fluid from the hotter overlying reservoir region into the horizontal well, while providing fluid communication and pressure differential between the colder overlying reservoir region and the horizontal well, sufficiently to cause hot fluids surrounding the colder overlying reservoir region to be drawn into and induce heating of the colder overlying reservoir region.

In some implementations, the flow control devices include hydraulically actuated valves.

In some implementations, the process further includes:

partitioning the horizontal well into well segments.

In some implementations, the step of partitioning the horizontal well into well segments includes providing isolation devices positioned along the horizontal well.

In some implementations, the step of operating the flow control devices further includes:

reducing flow of hydrocarbon-containing fluid from the hotter overlying reservoir region into at least one well segment located below the hotter overlying reservoir region, while providing fluid communication and pressure differential between at least one well segment located below the colder overlying reservoir region and the horizontal well.

In some implementations, the well segments include at least three well segments.

In some implementations, the at least three well segments consist of four well segments.

In some implementations, each well segment has a length of between about 10 and 500 meters.

In some implementations, the step of operating the flow control devices includes:

reducing flow of hydrocarbon-containing fluid from the hotter overlying reservoir region when the hydrocarbon-containing fluid from the hotter overlying reservoir region reaches an upper threshold temperature;

allowing the hydrocarbon-containing fluid from the hotter overlying reservoir region to cool to a lower threshold temperature; and then increasing flow of the hydrocarbon-containing fluid from the hotter overlying reservoir region.

In some implementations, the upper threshold temperature and the lower threshold temperature are based on a targeted upper sub-cool temperature and a targeted lower sub-cool temperature, respectively.

In some implementations, the targeted upper sub-cool temperature is between about 1 and about 5 degrees Celsius.

In some implementations, the targeted lower sub-cool temperature is between about 25 and about 50 degrees Celsius.

In some implementations, the step of providing fluid communication and pressure differential between the colder overlying reservoir region and the horizontal well is performed at a first pressure drawdown, and the step of increasing the flow of the hydrocarbon-containing fluid from the hotter overlying reservoir region is performed at a second pressure drawdown lower than the first pressure drawdown.

In some implementations, the hotter overlying reservoir region is located above a toe of the horizontal well.

In some implementations, the hotter overlying reservoir region is located above a heel of the horizontal well.

In some implementations, the process further includes:

measuring the temperatures of hydrocarbon-containing fluids at the plurality of locations along the horizontal well using a plurality of temperature sensors in order to identify the hotter overlying reservoir region and the adjacent colder overlying reservoir region.

In some implementations, the plurality of temperature sensors includes a plurality of distributed fiber-optic temperature sensors positioned along the horizontal well.

In some implementations, the step of operating the flow control devices includes operating the flow control devices located below the colder overlying reservoir region in an open position.

In some implementations, the step of operating the flow control devices includes impeding flow from the hotter overlying reservoir region into the horizontal well while enabling a lower flow rate.

In some implementations, the step of operating the flow control devices includes stopping flow from the hotter overlying reservoir region into the horizontal well.

In some implementations, the step of stopping the flow includes operating the corresponding flow control devices in a closed position.

In some implementations, the step of operating the flow control devices further includes:

maintaining a reduced flow of hydrocarbon-containing fluid from the hotter overlying reservoir region into the horizontal well until a level of hydrocarbon-containing fluid along the hotter overlying reservoir region reaches an upper threshold level; and then increasing flow of the hydrocarbon-containing fluid from the hotter overlying reservoir region.

In some implementations, the step of operating the flow control devices further includes:

maintaining a reduced flow of hydrocarbon-containing fluid from the hotter overlying reservoir region into the horizontal well until an average of the measured temperatures along the colder overlying reservoir region reaches an upper threshold value; and then increasing flow of the hydrocarbon-containing fluid from the hotter overlying reservoir region.

In some implementations, the step of operating the flow control devices further includes:

maintaining a reduced flow of hydrocarbon-containing fluid from the hotter overlying reservoir region into the horizontal well until a variance of the measured temperatures along the horizontal well relative to a maximum measured temperature reaches a lower threshold variance, such that the hotter and colder overlying reservoir regions together form an overlying conformance reservoir region; and then increasing flow of the hydrocarbon-containing fluid from the former hotter overlying reservoir region.

In some implementations, the process further includes:

monitoring the temperatures from the overlying conformance reservoir region to identify any additional temperature variations in the measured temperatures, to identify formation of a re-formed hotter overlying reservoir region and a re-formed adjacent colder overlying reservoir region; and operating the flow control devices in order to reduce flow of hydrocarbon-containing fluid from the re-formed hotter overlying reservoir region into the horizontal well while providing fluid communication and pressure differential between the re-formed colder overlying reservoir region and the horizontal well, thereby causing hot fluids surrounding the re-formed colder overlying reservoir region to be drawn into and induce heating of the re-formed colder overlying reservoir region.

In some implementations, the process further includes:

identifying at least one further hot overlying reservoir region and reducing flow of hydrocarbon-containing fluid from the further hot overlying reservoir region into the horizontal well; and/or identifying at least one further cold overlying reservoir region and providing fluid communication and pressure differential between the further cold overlying reservoir region and the production well.

In some implementations, the step of operating the flow control devices further includes reducing flow of hydrocarbon-containing fluid into the flow control device located below the overlying colder reservoir region that is closest to the overlying hotter reservoir once the hydrocarbon-containing fluids at the flow control device closest to the overlying hotter reservoir reach an upper fluid temperature.

In some implementations, the step of operating the flow control devices further includes sequentially reducing flow of hydrocarbon-containing fluid through a series of flow control devices located below the colder overlying reservoir region, starting from the flow control device proximate the hotter overlying reservoir region, once the hydrocarbon-containing fluids at each flow control device in the series sequentially reach an upper fluid temperature.

In some implementations, the horizontal well is part of a Steam-Assisted Gravity Drainage (SAGD) well pair including an overlying SAGD injection well.

In some implementations, the horizontal well is an infill well located in between two SAGD well pairs.

In some implementations, the horizontal well is a step-out well located beside an adjacent SAGD well pair.

In some implementations, there is provided a process for determining operation of a generally horizontal well located in a hydrocarbon-containing reservoir, including:

receiving temperature data of hydrocarbon-containing fluids from a plurality of locations along the horizontal well in order to identify a hotter overlying reservoir region and an adjacent colder overlying reservoir region; and determining flow control actions to reduce flow of hydrocarbon-containing fluid from the hotter overlying reservoir region into the horizontal well while providing fluid communication and pressure differential between the colder overlying reservoir region and the production well, sufficiently to cause hot fluids surrounding the colder overlying reservoir region to be drawn into and induce heating of the colder overlying reservoir region.

In some implementations, the process further includes determining an upper threshold temperature and a lower threshold temperature based on the temperature data, and the flow control actions include:

reducing flow of hydrocarbon-containing fluid from the hotter overlying reservoir region when the hydrocarbon-containing fluid from the hotter overlying reservoir region reaches an upper threshold temperature;

allowing the hydrocarbon-containing fluid from the hotter overlying reservoir region to cool to a lower temperature threshold; and then increasing flow of the hydrocarbon-containing fluid from the hotter overlying reservoir region.

In some implementations, the upper threshold temperature and the lower threshold temperature are based on a targeted upper sub-cool temperature and a targeted lower sub-cool temperature, respectively.

In some implementations, the targeted upper sub-cool temperature is between about 1 and about 5 degrees Celsius.

In some implementations, the targeted lower sub-cool temperature is between about 25 and about 50 degrees Celsius.

In some implementations, the flow control actions include:

preventing flow of hydrocarbon-containing fluid from the hotter overlying reservoir region.

In some implementations, the flow control actions include:

stopping flow of hydrocarbon-containing fluid from the hotter overlying reservoir region.

In some implementations, the flow control actions include:

maintaining a reduced flow of hydrocarbon-containing fluid from the hotter overlying reservoir region into the horizontal well until a level of hydrocarbon-containing fluid along the hotter overlying reservoir region reaches an upper threshold level; and then increasing flow of the hydrocarbon-containing fluid from the hotter overlying reservoir region.

In some implementations, the flow control actions include:

maintaining a reduced flow of hydrocarbon-containing fluid from the hotter overlying reservoir region into the horizontal well until an average of the measured temperatures along the colder overlying reservoir region reaches an upper threshold value; and then increasing flow of the hydrocarbon-containing fluid from the hotter overlying reservoir region.

In some implementations, flow control actions include:

maintaining a reduced flow of hydrocarbon-containing fluid from the hotter overlying reservoir region into the horizontal well until a variance of the measured temperatures along the horizontal well relative to a maximum measured temperature reaches a lower threshold variance, such that the hotter and colder overlying reservoir regions together form an overlying conformance reservoir region; and then increasing flow of the hydrocarbon-containing fluid from the former hotter overlying reservoir region.

In some implementations, the flow control actions further include:

monitoring the temperatures from the overlying conformance reservoir region to identify any additional temperature variations in the measured temperatures, to identify formation of a re-formed hotter overlying reservoir region and a re-formed adjacent colder overlying reservoir region; and operating the flow control devices in order to reduce flow of hydrocarbon-containing fluid from the re-formed hotter overlying reservoir region into the horizontal well while providing fluid communication and pressure differential between the re-formed colder overlying reservoir region and the horizontal well, thereby causing hot fluids surrounding the re-formed colder overlying reservoir region to be drawn into and induce heating of the re-formed colder overlying reservoir region.

In some implementations, the process further includes:

identifying at least one further hot overlying reservoir region and reducing flow of hydrocarbon-containing fluid from the further hot overlying reservoir region into the horizontal well; and/or identifying at least one further cold overlying reservoir region and providing fluid communication and pressure differential between the further cold overlying reservoir region and the horizontal well.

In some implementations, the step of operating the flow control devices further includes reducing flow of hydrocarbon-containing fluid into the flow control device located below the overlying colder reservoir region that is closest to the overlying hotter reservoir once the hydrocarbon-containing fluids at the flow control device closest to the overlying hotter reservoir reach an upper fluid temperature.

In some implementations, the step of operating the flow control devices further includes sequentially reducing flow of hydrocarbon-containing fluid through a series of flow control devices located below the colder overlying reservoir region, starting from the flow control device proximate the hotter overlying reservoir region, once the hydrocarbon-containing fluids at each flow control device in the series sequentially reach an upper fluid temperature.

In some implementations, the horizontal well is part of a Steam-Assisted Gravity Drainage (SAGD) well pair including an overlying SAGD injection well.

In some implementations, the horizontal well is an infill well located in between two SAGD well pairs.

In some implementations, the horizontal well is a step-out well located beside an adjacent SAGD well pair.

In some implementations, there is provided a process for hydrocarbon recovery using a generally horizontal well located in a hydrocarbon-containing reservoir, including:

operating flow control devices distributed along the horizontal well based on temperatures of hydrocarbon-containing fluids at a plurality of locations along the horizontal well, the temperatures of hydrocarbon-containing fluids indicating the presence of a hotter overlying reservoir region and an adjacent colder overlying reservoir region in the hydrocarbon-containing reservoir, the operating including:

reducing flow of hydrocarbon-containing fluid from the hotter overlying reservoir region into the horizontal well while providing fluid communication and pressure differential between the colder overlying reservoir region and the horizontal well at a first pressure drawdown, sufficiently to cause hot fluids surrounding the colder overlying reservoir region to be drawn into and induce heating of the colder overlying reservoir region; and then drawing hydrocarbon-containing fluid from the hotter overlying reservoir region into the horizontal well at second pressure drawdown lower than the first pressure drawdown while reducing flow of the hydrocarbon-containing fluid from the colder overlying reservoir region into the horizontal well.

In some implementations, the horizontal well is part of a Steam-Assisted Gravity Drainage (SAGD) well pair including an overlying SAGD injection well.

In some implementations, the horizontal well is an infill well located in between two SAGD well pairs.

In some implementations, the horizontal well is a step-out well located beside an adjacent SAGD well pair.

In some implementations, the hydrocarbons include heavy oil and/or bitumen.

In some implementations, there is provided a system for hydrocarbon recovery in a hydrocarbon-containing reservoir, including:

a generally horizontal well located in the hydrocarbon-containing reservoir;

a plurality of temperature sensors along the horizontal well configured to measure temperatures of hydrocarbon-containing fluids at a plurality of locations along the horizontal well in order to identify a hotter overlying reservoir region and an adjacent colder overlying reservoir region; and flow control devices distributed along the horizontal well, the flow control devices being operable to reduce flow of hydrocarbon-containing fluid from the hotter overlying reservoir region into the horizontal well and provide fluid communication and pressure differential between the colder overlying reservoir region and the horizontal well, sufficiently to cause hot fluids surrounding the colder overlying reservoir region to be drawn into and induce heating of the colder overlying reservoir region.

In some implementations, the flow control devices include hydraulically actuated valves.

In some implementations, the flow control devices located below the colder overlying reservoir region are operable in an open position.

In some implementations, the flow control devices located below the hotter overlying reservoir region are operable in a closed position.

In some implementations, the flow control devices located below the hotter overlying reservoir region are operable to prevent flow of hydrocarbon-containing fluid from the hotter overlying reservoir region.

In some implementations, the flow control devices located below the hotter overlying reservoir region are operable to stop flow of hydrocarbon-containing fluid from the hotter overlying reservoir region.

In some implementations, the system further includes isolation devices positioned along the horizontal well and partitioning the horizontal well into well segments, each well segment being associated with at least one of the flow control devices.

In some implementations, the isolation device includes packers.

In some implementations, the flow control devices are operable to:

reduce flow of hydrocarbon-containing fluid from the hotter overlying reservoir region into at least one corresponding hotter well segment of the well segments; and provide fluid communication and pressure differential between at least one well segment located below the colder overlying reservoir region and the horizontal well.

In some implementations, the well segments include at least three well segments.

In some implementations, the at least three well segments consist of four well segments.

In some implementations, each well segment has a length of between about 10 and 500 meters.

In some implementations, the hotter overlying reservoir region is located above a toe of the horizontal well.

In some implementations, the hotter overlying reservoir region is located above a heel of the horizontal well.

In some implementations, the plurality of temperature sensors includes a plurality of distributed fiber-optic temperature sensors.

In some implementations, the horizontal well is part of a Steam-Assisted Gravity Drainage (SAGD) well pair including an overlying SAGD injection well.

In some implementations, the horizontal well includes an infill well located in between two SAGD well pairs.

In some implementations, the horizontal well is a step-out well located beside an adjacent SAGD well pair.

In some implementations, the system further includes a controller configured to operate the flow control devices based on the temperatures of hydrocarbon-containing fluids measured by the plurality of temperature sensors.

In some implementations, the hydrocarbons include heavy oil and/or bitumen.

DETAILED DESCRIPTION

Figure 1:
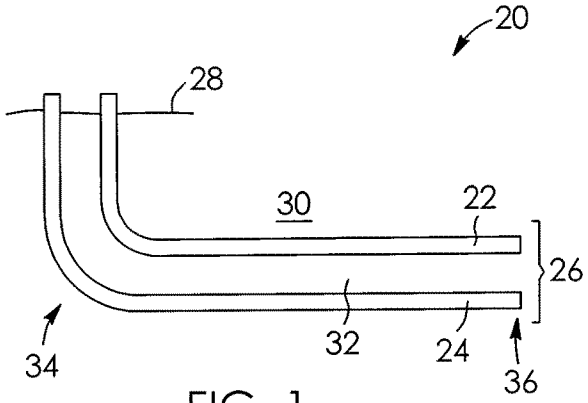
FIG. 1 is a side cross-sectional view schematic of a SAGD well pair.

Various techniques are described for enhancing hydrocarbon production in an in situ hydrocarbon recovery operation. By performing temperature measurements along a horizontal production well in a hydrocarbon-containing reservoir, hotter and colder reservoir regions overlying the production well can be identified. Production can be enhanced by operating distributed flow control devices to reduce or stop production from hotter reservoir regions while favoring or initiating production from colder reservoir regions, in order to cause hot fluids surrounding the colder regions to be drawn into and induce heating of the colder regions. Once the colder regions have been heated and are producing, production from the hotter regions can be resumed. While temporarily producing less from the hotter regions can, in some scenarios, result in a temporary reduction in production rates from the well, the conformance along the well can be enhanced such that once production is reinitiated the overall production is improved. For instance, colder regions that would otherwise provide little or no production can be sufficiently heated to facilitate improved production from those regions. In such scenarios, short-term decreases in production are endured at the benefit of longer-term gains, as the increase in production from the colder regions more than offsets a temporary loss in production from the hotter regions. Various hydrocarbon recovery processes described herein can be referred to as "intelligent well" or "smart well" hydrocarbon recovery processes.

In some implementations, hydrocarbon-containing fluids from the hotter and colder reservoir regions can be produced at different pressure drawdowns to improve well conformance and production rates along the production well. In some implementations, the horizontal production well can be partitioned into well segments using isolation devices, such that each well segment is associated with at least one of the flow control devices. By selecting which and when segments are produced, temperature conformance and production rates can be improved.

In some existing systems, flow control devices have been used to manage flow of hydrocarbon-containing fluids into production well segments to promote steam chamber conformance, prevent steam breakthrough, and achieve a target sub-cool temperature. As used herein, the term "sub-cool temperature" is intended to refer to a "reservoir sub-cool temperature", which in steam-injection implementations corresponds to the temperature difference between the steam chamber saturation temperature (e.g., based on the steam chamber pressure) and a measured temperature at a location outside of the steam chamber (e.g., the measured temperature of hydrocarbon-containing fluids drawn into the production well from the reservoir). The measured temperature is typically of fluids located proximate to the steam chamber, such as production fluids located within the production well, just outside of the production well, and/or entering the production well from the overlying reservoir region. In other implementations where steam is not necessarily used, such as ISC or solvent-assisted processes, the reservoir sub-cool temperature can refer to the temperature difference between the mobilization chamber (e.g., combustion chamber or solvent-depletion chamber) and a measured temperature at a location outside of the mobilization chamber.

However, in contrast to existing systems, in some implementations, the hydrocarbon recovery processes include operation of flow control devices not only to keep the production fluid temperature below the steam temperature and thus preventing steam breakthrough, but also to improve production by selectively reducing or stopping production from hotter and more productive reservoir regions in order to warm up adjacent colder and less productive regions so as to enable a generally hotter temperature profile along the well and improved performance. More regarding the various operational and structural features of the hydrocarbon recovery techniques will be described in greater detail below.

Production Well Implementations

The hydrocarbon recovery techniques described herein can be implemented in various types of production wells that require or could benefit from improved temperature and production conformance. For example, in some implementations, the production well can be part of a SAGD well pair including an overlying SAGD injection well, or can be operated as another production well, such as an infill well or a step-out well, that is part of a SAGD operation. Alternatively, in some implementations, some techniques described herein for promoting temperature and production conformance can be used for Cyclic Steam Stimulation (CSS) wells or In Situ Combustion (ISC) wells.

Referring to FIG. 1, a SAGD operation 20 can include an injection well 22 overlying a production well 24 to form a well pair 26. Each well includes a vertical section extending from the surface 28 into the hydrocarbon-containing reservoir 30, and a generally horizontal section that extends within a pay zone of the hydrocarbon-containing reservoir 30. The injection well 22 and the production well 24 are separated by an interwell region 32 that is typically immobile at initial reservoir conditions. During startup mode, the interwell region 32 is mobilized by introducing heat, typically conveyed by a mobilizing fluid such as steam, into one or more of the wells.

In some implementations, steam is injected into the injection well 22 and the production well 24 to heat the interwell region 32 and mobilize the hydrocarbons to establish fluid communication between the two wells. Other mobilizing fluids, such as organic solvents, can also be used to mobilize the reservoir hydrocarbons by heat and/or dissolution mechanisms. The well pair 26 also has a heel 34 and a toe 36, and it is often desired to circulate the mobilizing fluid along the entire length of the wells. Once the well pair 26 has fluid communication between the two wells, the well pair can be converted to normal operation where steam is injected into the injection well 22 and the production well 24 is operated in production mode to supply hydrocarbons to the surface 28.

Figure 2:
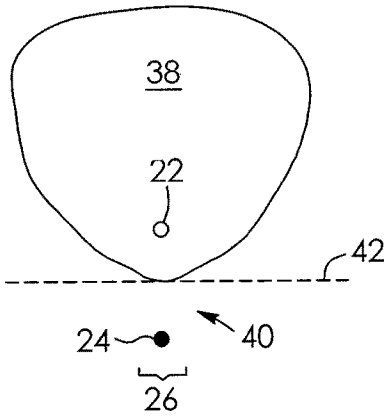
FIG. 2 is a front cross-sectional view schematic of a SAGD well pair.

Referring now to FIG. 2, the operation of the SAGD well pair 26 eventually leads to the formation and growth of a steam chamber 38 extending generally upward and outward from the injection well 22 and into the reservoir 30, thereby heating the hydrocarbons sufficiently to reduce their viscosity and allow the hydrocarbons to drain downward under gravity toward the production well 24 along with condensed water. At steady-state operation, it is generally desirable that a layer 40 of hydrocarbon-containing fluid be maintained above the production well 24 to prevent steam from the injection well 22 from breaking through directly into the production well 24. The boundary between the top of the fluid layer 40 and the bottom of the steam chamber 38 defines a steam-fluid interface 42. Avoiding or at least mitigating steam breakthrough can be achieved by adjusting the fluid withdrawal rate from the production well 24 such that the temperature of the produced hydrocarbon-containing fluid remains below the steam saturation temperature by a predetermined "sub-cool" temperature. In particular, the production rate can be controlled to maintain the hydrocarbon-containing fluid layer 40.

Figure 3:
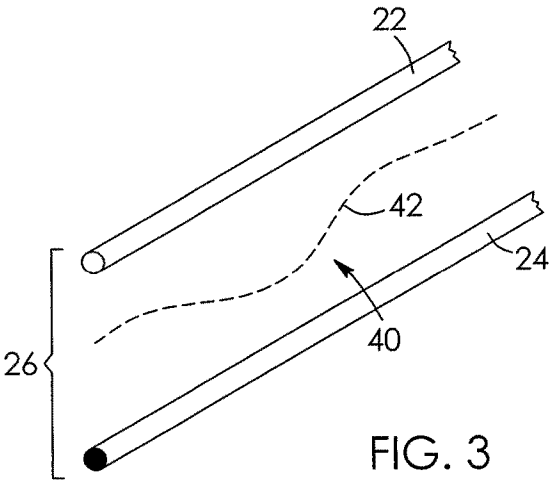
FIG. 3 is a perspective side view schematic of a SAGD well pair, illustrating the steam-fluid interface level above the production well.

Referring to FIG. 3, the level of the steam-fluid interface 42 can vary along the length of a given SAGD well pair 26, and this variation in turn can impact SAGD production rates. Factors contributing to longitudinal variations in the steam-fluid interface level can include, for example, reservoir geology and fluid properties in the vicinity of the well pair 26 as well as uniformity of the injected steam pressure and quality along the length of the well pair 26.

Figure 4:
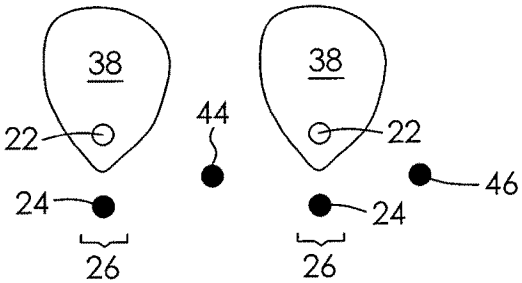
FIG. 4 is a front cross-sectional view schematic of a SAGD well pair, an infill well and a step-out well.

Turning now briefly to FIG. 4, SAGD well pairs 26 can be arranged in generally parallel relation to each other to form an array of well pairs. As the SAGD operation 20 progresses, steam chambers 38 form and grow above respective injection wells 22. Infill wells 44 can be drilled, completed and operated in between SAGD well pairs, and step-out wells 46 can be drilled, completed and operated adjacent to one SAGD well pair. In some scenarios, such infill and step-out wells can benefit from the various techniques described herein, in particular since temperature variations along infill wells and step-out wells are often even more pronounced than along well pair production wells.

Production Well Completion

Figure 5:
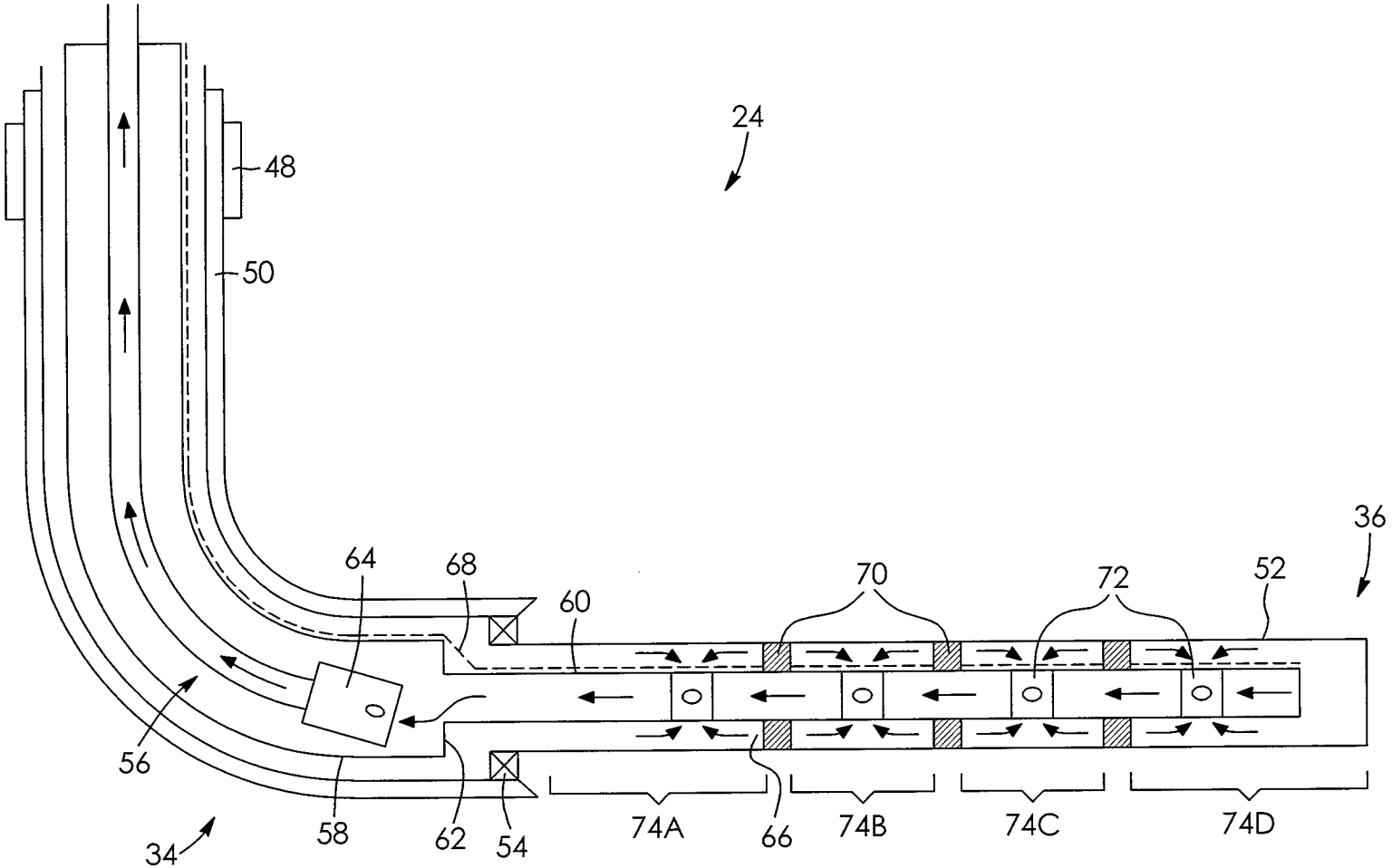
FIG. 5 is a side cross-sectional view schematic of a production well including distributed isolation device and flow control devices, in a production mode.

Referring to FIG. 5, in some implementations the production well 24 is completed with tubing and/or liner structures. The production well completion can also include devices for flow control, isolation, artificial lifting and pumping, instrumentation deployment, gravel packing and/or various other completion structures for ensuring functionality and stability of the production well 24. The completion design can be provided to improve temperature and production conformance along the production well 24, in accordance with various techniques described herein. More regarding the construction and operation of the production well 24 will be discussed further below. It should be noted that the production well 24 can assume different constructions and configurations, depending on the particularities of the hydrocarbon recovery process in which the well is employed and the components used to complete the well.

In some implementations, the production well 24 includes a surface casing 48 provided at an inlet of the wellbore proximate to the surface, and an intermediate casing 50 provided within the wellbore and extending from the surface downward into the reservoir in the vertical section of the wellbore, in the curved intermediate section of the wellbore, and in part of the horizontal section of the wellbore at the heel 34. The production well 24 also includes a liner 52 provided in the horizontal portion of the wellbore. The liner 52 can be installed by connection to a distal part of the intermediate casing 50 via a liner hanger 54. The liner 52 can have various constructions including various slot patterns, blank sections, and other features designed for the given application and reservoir characteristics. It should be noted that in other implementations the liner 52 need not be a slotted liner, but can be another type of liner, for example a wire wrapped screen liner.

Referring still to FIG. 5, in some implementations the production well 24 can include a slave string 56 installed to extend from the surface within the intermediate casing 50 all the way to the toe 36 of the production well 24. The slave string 56 includes a first portion 58 that extends from the surface to a location that is proximate and upstream of the liner hanger 54, and a second portion 60 that extends from a distal end of the first portion into the liner 52. The slave string 56 can also include a cross-over portion 62 in between the first portion 58 and the second portion 60 for transitioning from a larger diameter to a smaller diameter. The first portion 58 of the slave string 56 can be sized and configured to receive a pump 64, which can be an electrical submersible pump (ESP) or another artificial lift device. The second portion 60 of the slave string 56 can also be referred to as a "tailpipe" and is sized for insertion into the liner 52. The second portion 60 can be sized to define an annulus 66 between an outer surface of the second portion 60 of the slave string 56 and an inner surface of the liner 52. The second portion 60 can extend from a location proximate to and upstream of the liner hanger 54 to the toe 36 of the production well 24.

An instrumentation line 68 can be provided running along and clamped to an external surface of the slave string 56. The instrumentation line 68 can be equipped with various devices for detecting or measuring characteristics of the reservoir and/or the process conditions. The instrumentation line 68 can include optical fibers, thermocouples, pressure sensors and/or acoustic sensors which can be strapped to the outside of the slave string 56. In particular, in some implementations the instrumentation line 68 can include a plurality of temperature sensors distributed along the horizontal section of the production well 24 and implemented, for example, by fiber-optic temperature sensors. In some implementations, the instrumentation line 68 can also include pressure and/or acoustic sensors distributed along the horizontal section of the production well 24.

The instrumentation line 68 can be configured to enable data acquisition to facilitate evaluation of different parameters, such as temperatures, pressures, flow rates, etc., along the entire or a part of the length of the well 24 during production. The hydrocarbon recovery process can be regulated based on the data collected via the instrumentation line 68, as described further below.

Referring still to FIG. 5, the production well 24 can include isolation devices 70 and flow control devices 72 for enabling certain flow characteristics during production. The isolation devices 70 can include packers such as well packers or inflatable packers, or other types of flow diverters. The isolation devices are used for partitioning or isolating the production well 24 into well segments 74A to 74D. Each isolation device 70 can be located between two adjacent flow control devices 72.

The flow control devices 72 can include hydraulically or electrically actuated valves or any other suitable devices, and can be operated to selectively allow or prevent flow of hydrocarbon-containing fluid into a given segment in order to enhance temperature and production conformance. In some implementations, the actuation of the flow control devices 72 can involve manual intervention methods using, for example, coiled tubing or wireline. In particular, the flow control devices 72 can be controlled to regulate where production fluid enters the liner 52 from the reservoir, for instance by opening certain flow control devices while closing or restricting others, in order to promote equalizing inflow and temperature along the length of the well. The flow control devices 72 can be any device or system that can be employed to regulate flow into the production well 24. Depending on the intended application, the flow control devices 72 can be configured for on-off and/or throttling operation.

FIG. 5 illustrates fluid flow in production mode, where hydrocarbon-containing production fluids that flow through the slots in the liner 52 will be isolated within a corresponding segment of the liner 52 and be forced to flow into one or more corresponding flow control devices 72 provided in that corresponding segment. In the scenario of FIG. 5, the production well 24 includes three isolation devices 70 for partitioning the well into four well segments 74A to 74D, each well segment being provided with a corresponding flow control device 72 that can regulate flow at that segment. In other implementations, the production well can be partitioned into more or less than four segments.

It should be noted that the number, size, separation, construction and configuration of the isolation devices and flow control devices can be varied in other scenarios. In some implementations, the separation between each isolation device, and thus the length of each well segment can be between about 10 meters and about 500 meters. The separation between adjacent isolation devices can be substantially similar of different for each adjacent pair. The separation between adjacent isolation devices can also be based on the lengths of other well completion components. For example, the separation between adjacent isolation devices can correspond to the lengths of the casing and/or liner joints, which can be about 10 meters to about 15 meters in length. The separation between adjacent isolation devices can be provided based on the total length of the production well, such that the production well is divided into corresponding segments.

Depending on the intended application, one or multiple flow control devices can be provided within each segment. Additionally, in some implementations, flow control devices can be provided along the length of the production well to enhance reservoir production by drawing down hydrocarbon-containing fluid from selected overlying reservoir regions without any isolation device being provided to partition the production well into well segments. Examples of well configurations in which the techniques described herein could be applied without isolation devices can include liner-deployed completion designs using the formation sand packing around the liner to provide natural isolation, and completions designs where the size of the annulus between the tubing and the surrounding liner is provided so as to naturally provide an enhanced flow restriction between adjacent flow control devices. More regarding the operation of the isolation devices and flow control devices will be discussed further below.

Distributed Temperature Measurements

In a SAGD operation, the temperature profile of the hydrocarbon-containing fluids overlying the production well is generally not uniform along the length of the production well. Factors including reservoir geology and fluid composition heterogeneities, operational practices and constraints, well completion designs, adjacent well pairs in the reservoir, and steam chamber pressure variations can reduce the temperature conformance along the production well. For example, in some SAGD operations, temperature variations of about 50 degrees Celsius or greater between the hottest and coldest reservoir regions overlying the production well can be observed.

In some implementations, the hydrocarbon recovery process can include measuring temperatures of hydrocarbon-containing fluids at a plurality of locations along the horizontal production well using a plurality of temperature sensors. In this regard, FIGS. 6A to 6D show a scenario in which a horizontal production well 24 is provided in a hydrocarbon-containing reservoir 30. The production well 24 includes a plurality of distributed temperature sensors 76 and a plurality of distributed flow control devices 72. The temperature sensors 76 can include distributed fiber-optic temperature sensors and the flow control devices 72 can include hydraulically actuated valves.

A controller 78 located at the surface can retrieve the temperature data measured by the temperature sensors 76 and, in response, remotely actuate the flow control devices 72 via dedicated control lines to regulate flow of hydrocarbon-containing fluids 80 from the reservoir 30. Depending on the intended application, actuation of the flow control devices 72 can involve different degrees of automation. For example, some implementations can involve operator interpretation of the temperature data, and manual operation of the flow control devices 72 via the dedicated control lines. In other implementations, the interpretation of the temperature data and the actuation of the flow control devices in response to the temperature data can be fully or partially automated by the controller. In some implementations, the temperature measurements are performed while the production well is in production mode. Alternatively, in some implementations, the production well can be shut-in prior to performing the temperature measurements in order to obtain temperature fall-off data.

It should be noted that the number and location of the temperature sensors 76 along the production well 24 can, but need not, correspond to the number and location of the flow control devices 72, such that various configurations can be implemented. In some implementations, the separation between adjacent flow control devices 72 is significantly larger than the corresponding separation between adjacent temperature sensors. The separation between adjacent flow control devices 72 can be at least about an order of magnitude greater than the separation between adjacent temperature sensors 76. For example, the distance between adjacent temperature sensors 76 can be between about 1 and about 40 meters, while the distance between adjacent flow control devices 72 can be between about 10 meters and about 500 meters. It is to be noted that these ranges are provided for illustrative purpose and the techniques described herein can be operated outside these ranges. The distances between adjacent flow control devices and temperature sensors can, for example, be based on factors such as production well size, configuration, completion and operation, and reservoir properties.

Figure 6A:
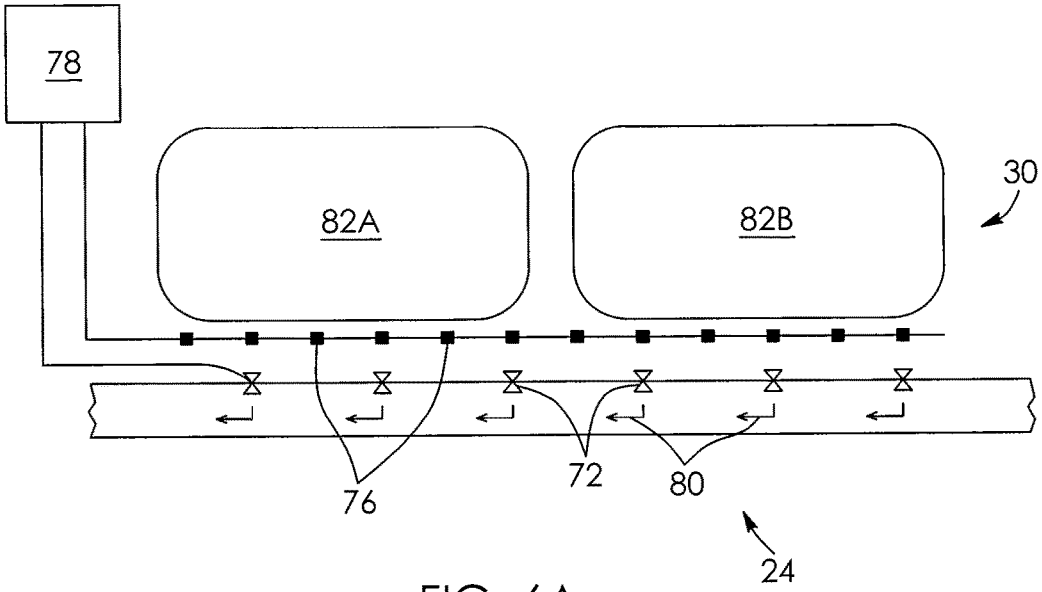
FIGS. 6A to 6D are side cross-sectional view schematics of a production well including flow control devices, illustrating different steps of an implementation of the hydrocarbon recovery process.

The temperature data measured by the temperature sensors 78 can be collected and analyzed to generate a temperature profile along the length of the production well 24. Referring to FIG. 6A, in some implementations, the hydrocarbon recovery process includes identifying a hotter overlying reservoir region 82A and an adjacent colder overlying reservoir region 82B based on the measured temperatures. While for simplicity only one hotter reservoir region 82A and one colder reservoir region 82B are identified in FIG. 6A, the various techniques described herein can be performed for different numbers and configurations of overlying reservoir regions having different temperature profiles. The location of the hotter and colder reservoir regions can also vary along the length of the production well depending on factors such as reservoir geology and fluid composition, operational practices and constraints, well completion designs, the presence of other well pairs in the reservoir, reservoir maturity, steam chamber pressure variations, and so on. Furthermore, the respective lengths of the hotter and colder reservoir regions need not be same and can vary over time in a given reservoir.

Figure 7A:
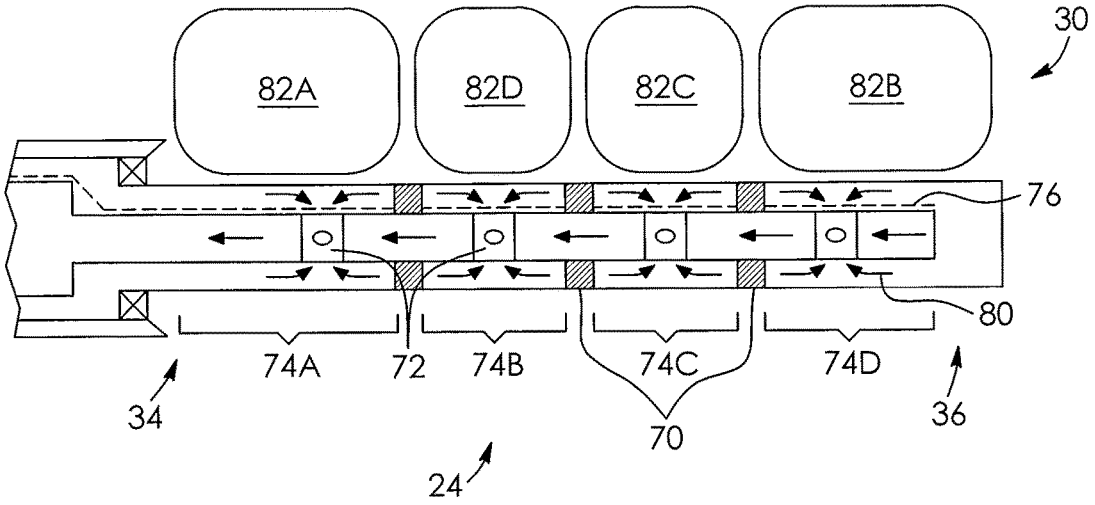
FIGS. 7A to 7F are side cross-sectional view schematics of a production well including flow control devices, illustrating different steps of another implementation of the hydrocarbon recovery process.

In some implementations, the hydrocarbon recovery process includes identifying multiple pairs of hotter and colder overlying reservoir regions. Referring to FIG. 7A, in one scenario the completion of the production well 24 corresponds to the completion described above with reference to FIG. 5, and the temperature measurements can allow for the identification of more than two (e.g., four) overlying reservoir regions 82A to 82D. In some implementations, the temperature measurements can indicate that the hottest reservoir region 82A overlies segment 74A near the heel 34 of the wed, the second hottest reservoir region 82B overlies segment 74D near the toe 36 of the well, the third hottest reservoir region 82C overlies segment 74C, and the coldest reservoir region 82D overlies segment 74B. It should be noted that in other scenarios, each of the hotter and colder reservoir regions can overlie less or more than one well segment, and that the boundary between adjacent hotter and colder reservoir regions need not be aligned with the boundary between adjacent well segments. In some scenarios, production wells with more complicated temperature profiles can be considered, as long as at least one hotter reservoir region and at least one adjacent colder reservoir region can be identified.

Flow Control Operations

In some implementations, once the hotter and adjacent colder overlying reservoir regions are identified, the hydrocarbon recovery process can include operating flow control devices distributed along the horizontal well based on temperatures of hydrocarbon-containing fluids. Operating the flow control devices can include reducing production from the hotter overlying reservoir region, while simultaneously providing fluid communication and pressure differential between the colder reservoir region and the production well, sufficiently to cause hot fluids surrounding the colder reservoir region to be drawn into and induce heating of the colder reservoir region. More regarding the heat transfer mechanisms involved for heating the colder reservoir region will be discussed further below.

In the scenario of FIG. 6A, a hotter reservoir region 82A and an adjacent colder reservoir region 82B have been identified through temperature measurements of hydrocarbon-containing fluids overlying the horizontal well 24. At this step, all the flow control devices 72 can be in an open position so as to draw hydrocarbon-containing fluids 80 from the overlying reservoir 30 into the production well 24. Low temperature and production conformance is observed along the well 24. In particular, in this scenario, the section of the production well 24 located below the hotter reservoir region 82A shows a higher production rate than the section of the well 24 located below the colder reservoir region 82B. This phenomenon is generally due to colder reservoir regions having more viscous and thus less mobile hydrocarbon-containing fluids. At the same time, because the hotter reservoir region 82A produces fluid more easily, the hotter reservoir region 82A is more easily depleted than the colder reservoir region 82B.

Figure 9A:
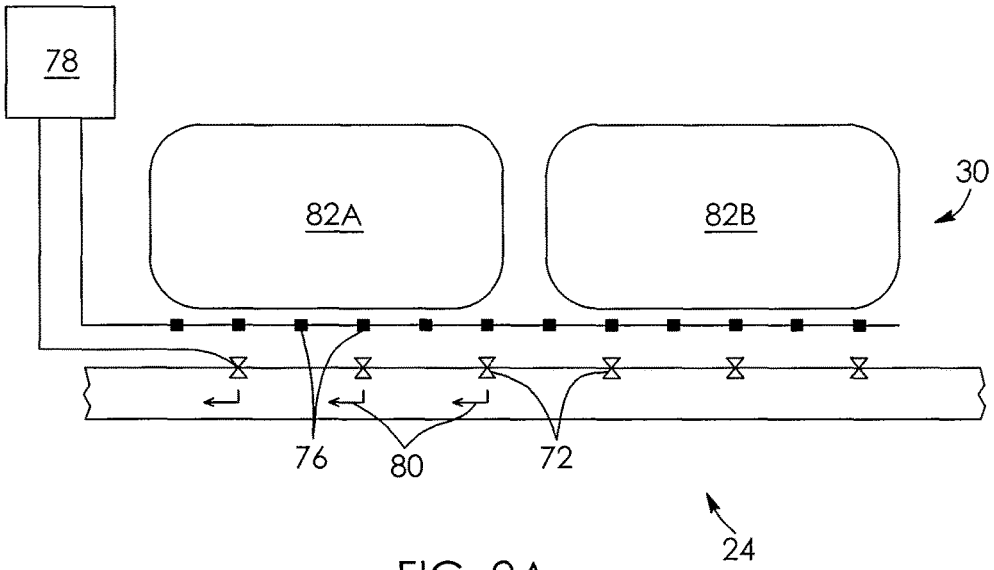
FIGS. 9A to 9F are side cross-sectional view schematics of a production well including flow control devices, illustrating different steps of an implementation of the hydrocarbon recovery process.

In the scenario of FIG. 6A, the hydrocarbon-containing fluids 80 in the colder reservoir region 82B are initially sufficiently warm to flow into the production well 24 and be produced to the surface, albeit at a lower production rate compared to the fluids 80 pulled from the hotter reservoir region 82A. In other scenarios, however, the colder reservoir region can include immobile hydrocarbons and/or hydrocarbons that are not sufficiently mobile to flow into the underlying portion of the production well. For example, referring briefly to FIG. 9A, the hydrocarbon-containing fluids 80 in the colder reservoir region 82B can initially be too cold and thus too viscous to readily flow into the production well 24.

Figure 6B:
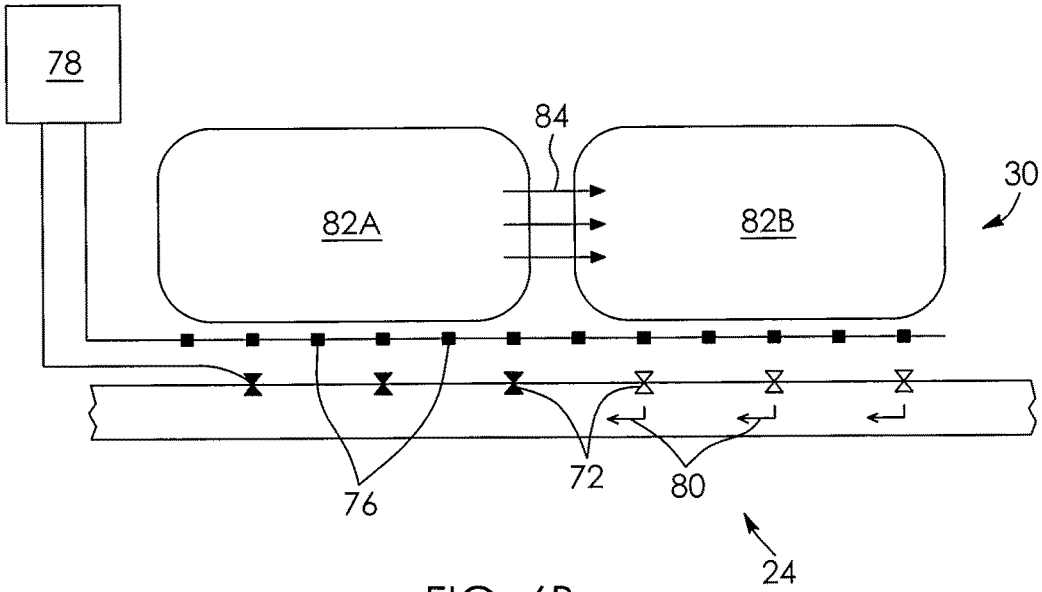

Turning now to FIG. 6B, in some implementations, operating the flow control devices to heat the colder reservoir region 82B involves operating the flow control devices 72 under the hotter overlying reservoir region 82A in a closed or partially closed position so as to stop or impede flow into the production well 24, while operating the flow control devices 72 under the colder reservoir region 82B in an open or partially open position so as to enable or promote flow into the production well 24. In FIG. 6B, the colder reservoir region 82B is already producing upon closing the flow control devices under the hotter reservoir region 82A. However, referring to FIG. 9B, in some scenarios where the colder reservoir region 82B include immobile hydrocarbons and/or hydrocarbons that are not sufficiently mobile to flow into the underlying portion of the production well 24, reducing or stopping flow from the hotter reservoir region 82A involves an initial mobilization phase in which heat 84 transferred to the colder overlying reservoir region 82B serves to warm up and mobilize the hydrocarbon-containing fluids 80 within the colder overlying reservoir region 82B.

Depending on several factors including, for example, reservoir geology, steam chamber development, and well operation and completion design, various heat transfer mechanisms can be involved to heat up the colder overlying reservoir regions. For example, referring to FIG. 6B, in some implementations, impeding production from the hotter reservoir region 82A while allowing production from the colder reservoir region 82B in order to provide fluid communication and pressure differential between the colder reservoir region 82B and the production well 24 create forced convection of heat 84 toward the colder reservoir region 82B. As a result of this forced convection, hot fluids surrounding the colder reservoir region 82B are pulled into and induce heating of the colder reservoir region 82B.

Figure 9B:
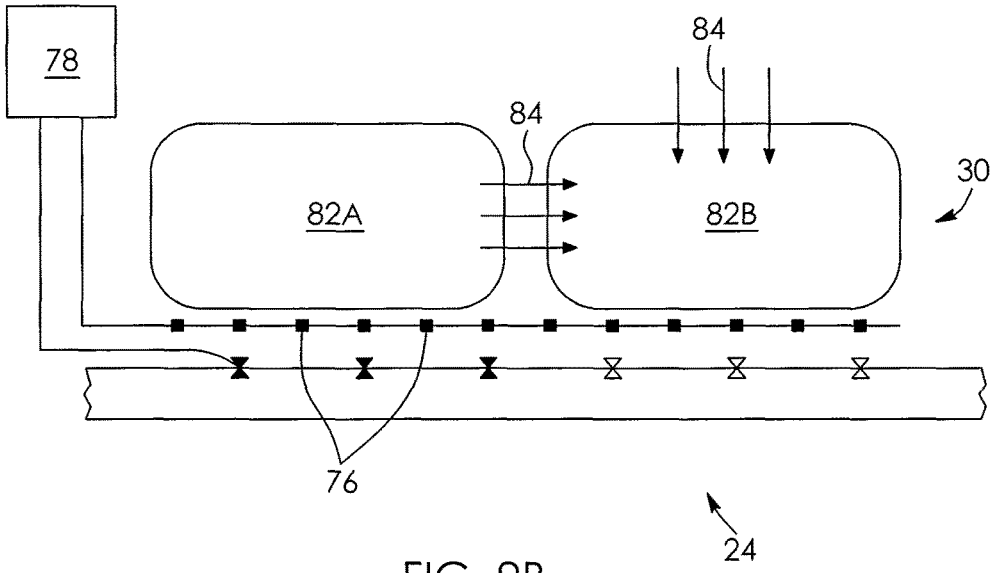

In some implementations, the surrounding hot fluids can be transferred laterally from the hotter reservoir region 82A into the colder reservoir region 82B, as depicted schematically in FIG. 6B. Alternatively or additionally, hot fluids can be transferred from the overlying steam chamber to warm up the colder reservoir region 82B, as depicted in FIG. 9B. Heat conduction toward the colder reservoir region 82B can occur. Furthermore, in some implementations, steam could be injected through the flow control devices 72 lying under the colder reservoir region 82B to further help increase the temperature of the colder reservoir region 82B. Such a steam injection process can be carried out either during the startup mode of the well (e.g., bullheading), or as a temporary operating mode after the horizontal well 24 has transitioned into production mode.

Referring still to FIG. 6B, in some implementations, upon reducing flow from the hotter reservoir region 82A and promoting flow from the colder reservoir region 82B, the temperature and flow rate of hydrocarbon-containing fluids 80 produced to the surface generally exhibit an initial drop. However, over time, shutting in the flow control devices 72 located below the hotter reservoir region 82A causes hot fluids to accumulate in the hotter reservoir region 82A, and eventually encourages hot fluids from the adjacent hotter reservoir region 82A and/or from the overlying steam chamber to flow into and heat the colder reservoir region 82B. As fluids in the colder reservoir region 82B become hotter, the temperature conformance along the well 24 is enhanced, flow rates from the colder reservoir region 82B increase, and the steam-fluid interface overlying the colder reservoir region 82B descends closer toward the production well 24.

Referring to FIGS. 9B to 9E, in some implementations, the heat front from the adjacent hotter reservoir region 82A and/or from the overlying steam chamber progressively advances into the colder reservoir region 82B, such that the portion of the colder reservoir region 82B that is closest to the hotter reservoir region 82A undergoes an increase in temperature and production rate before portions of the colder reservoir region 82B that are located farther away from the hotter reservoir region 82A. The flow control devices 72 below the colder reservoir region 82B can be regulated accordingly, for example by progressively closing the flow control devices as the heating of the overlying reservoir progresses into the colder reservoir region. More regarding the regulation of the flow control devices will be described further below.

Figure 9C:
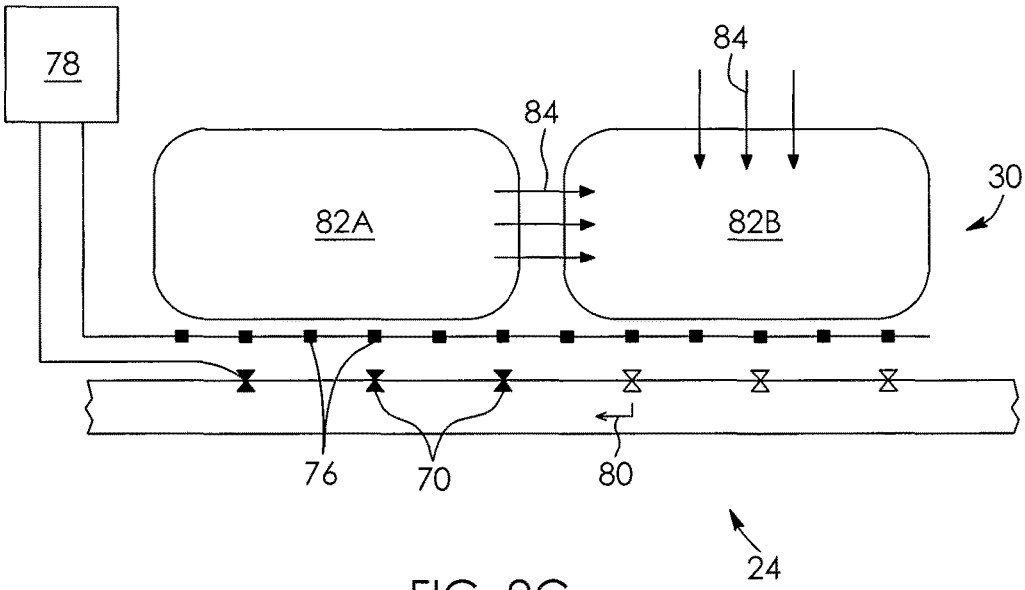
Figure 9D:
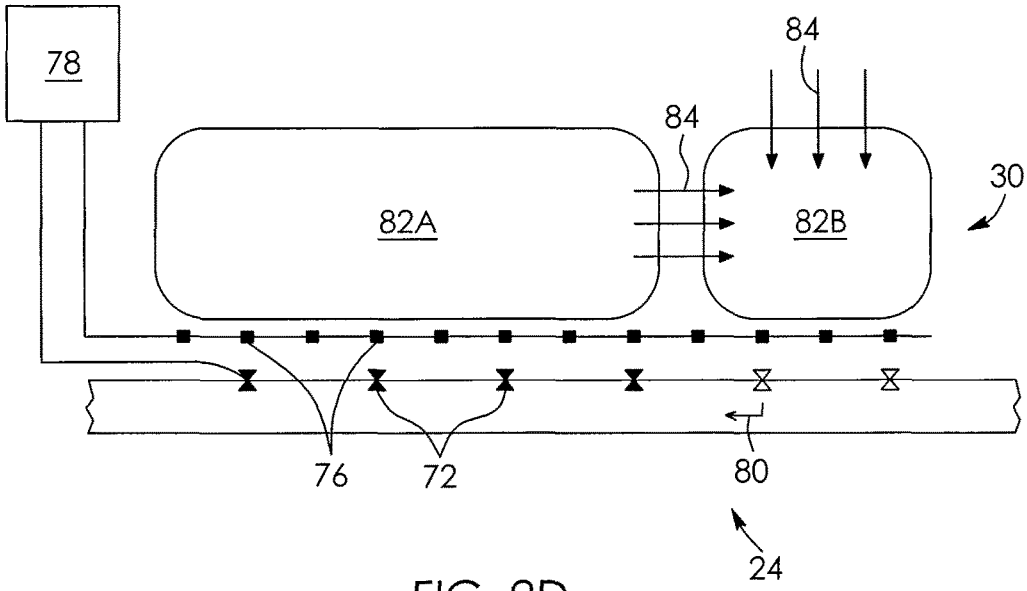
Figure 9E:
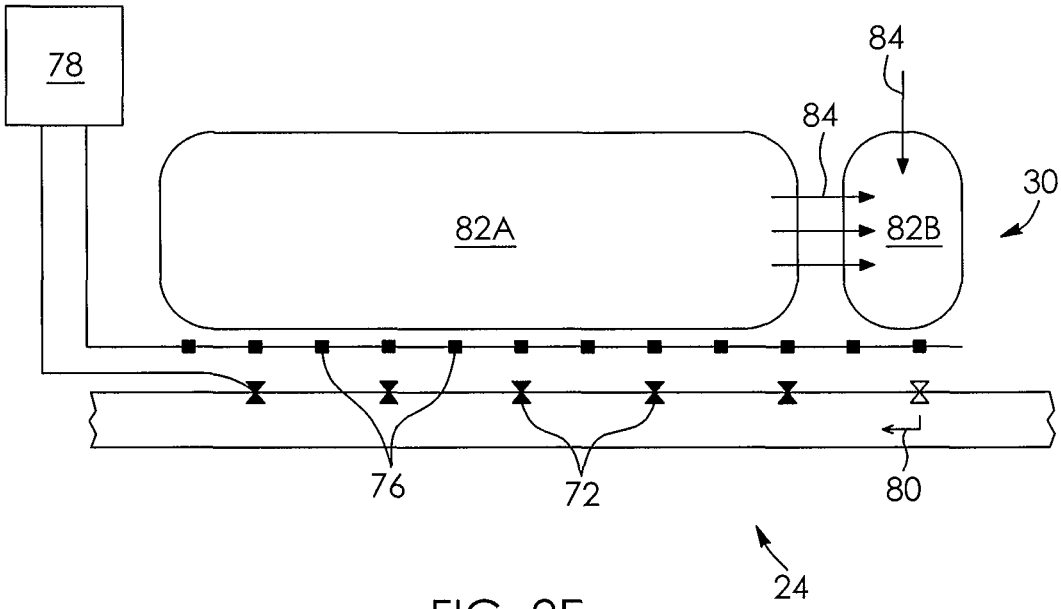
Figure 9F:
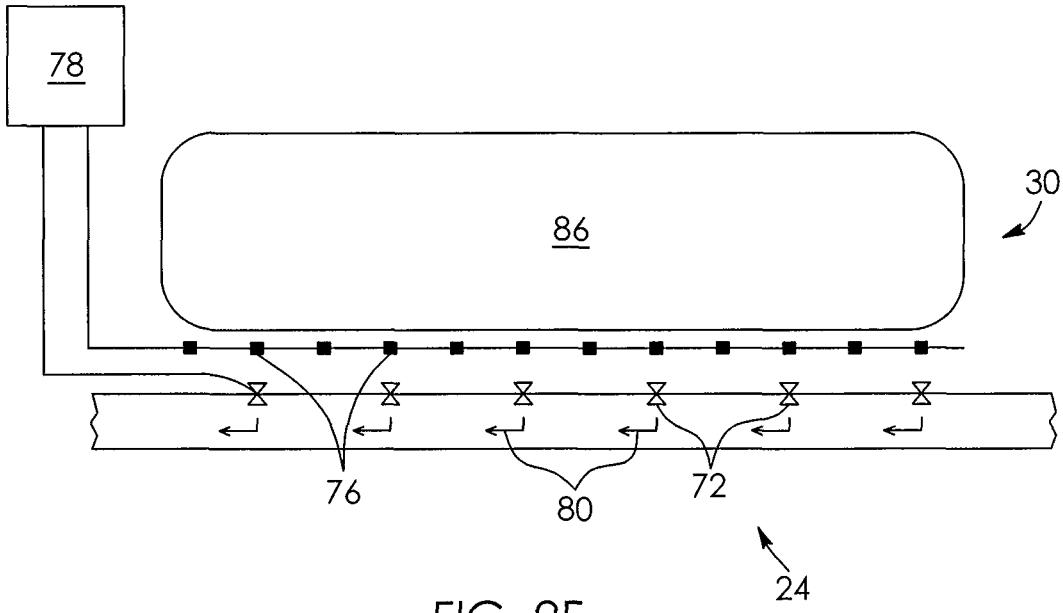

Referring more specifically to FIGS. 9C and 9D, some implementations involve reducing flow of hydrocarbon-containing fluids 80 into the flow control device 72 located below the colder reservoir region 82B that is closest to the hotter reservoir region 82A once the fluid temperature measured at that particular flow control device 72 reaches an upper fluid temperature. Furthermore, referring also to FIG. 9E, some implementations can involve sequentially reducing or ceasing production from a series of flow control devices 72 located below the colder reservoir region 82B. Flow reduction can start at the flow control device 72 proximate the hotter reservoir region 82A (see, e.g., FIG. 9D) and progress away from the hotter reservoir region 82A (see, e.g., FIG. 9E). Reducing flow into a given flow control device 72 in the series can be initiated once measured fluid temperature at that flow control device 72 reaches a certain upper fluid temperature.

Figure 6C:
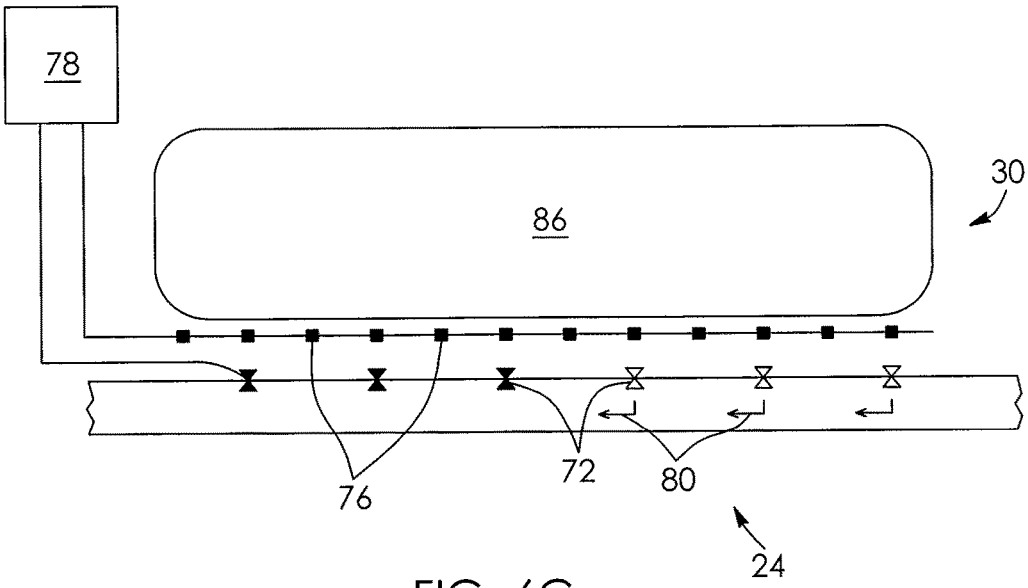

Turning now to FIG. 6C, in some implementations, preventing flow from the hotter reservoir region eventually causes the hotter and colder reservoir regions to evolve into a conformance reservoir region 86 overlying the production well 24. The conformance reservoir region 86 exhibits an enhanced temperature conformance compared to the initial temperature conformance of the former hotter and colder reservoir regions. The term "enhanced temperature conformance" is used here to denote that the average temperature along the well 24 has increased because a larger portion of the length of the well 24 is at a temperature close or equal to the temperature of the former hotter reservoir region. Accordingly, enhanced temperature conformance can be achieved if the temperature of the colder reservoir region and/or the longitudinal extent of the hotter reservoir region increase after production from the hotter reservoir region has been prevented or impeded for a certain period of time. It should be noted that the criteria for assessing whether appropriate temperature conformance is achieved can vary from one production well to another depending on various factors, such as well maturity, reservoir geology, well location and completion, and so on.

Figure 6D:
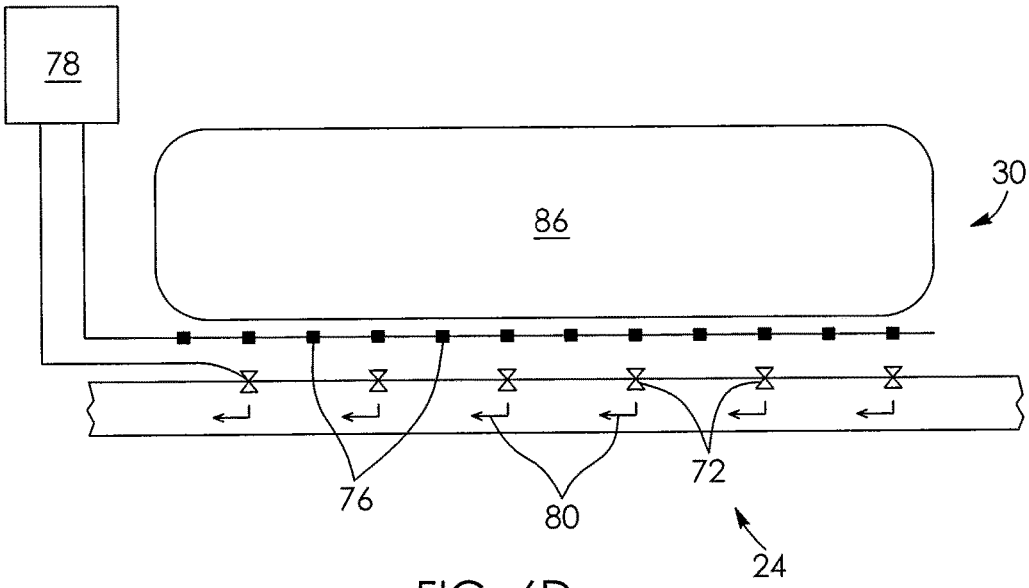

Referring now to FIGS. 6B to 6D, in some implementations, operating the flow control devices 72 can involve maintaining a reduced flow of hydrocarbon-containing fluid from the hotter reservoir region 82A into the production well 24 until a variance of the fluid temperatures measured along the well 24 relative to a maximum measured temperature reaches a lower threshold variance such that the hotter and colder overlying reservoir regions 82A, 82B together form the overlying conformance reservoir region 86. Once this lower threshold variance is reached, the flow of hydrocarbon-containing fluid from the former hotter overlying reservoir region can be reinitiated or re-increased. The term "variance" is meant here to represent a measure of how the fluid temperatures measured along a given part of the production well tend to be close to the hottest of the measured temperatures, such that a small variance is indicative not only of an enhanced degree of uniformity in the temperature profile of the well but also of a higher average temperature.

For example, in some implementations, once the measured temperatures along the well are all within about 10 to about 30 degrees Celsius from the hottest temperature, and the hotter reservoir region has not significantly cooled in the process, the overlying region can be considered to have reached sufficient temperature conformance to return to normal inflow along the well. The criteria according to which the lower threshold variance is determined in a given implementation can be based on different factors including, without being limited to, the spacing between the flow control devices, the geological properties of the reservoir, and the presence of adjacent well pairs or pads. As a result, in some implementations, one can obtain a more uniform and a generally hotter temperature profile along the production well, which can lead to an increased overall production rate once normal inflow is returned the well underlying the conformance reservoir region 86.

It should also be noted that, while in the scenario of FIGS. 6B and 6C the flow control devices located below each overlying reservoir are operated in the same manner, this need not be the case in other scenarios. In particular, each flow control device can be operated independently of the other flow control devices. For example, in some situations, production from each of the flow control devices located below the hotter reservoir region can be reduced, prevented or stopped, partially or completely, at different moments in time and during different time intervals to achieve greater control over the temperature and inflow distribution along the length of the production well. In particular, as mentioned above, when production from the hotter reservoir region is prevented or impeded in the process of heating the colder reservoir region, the hot fluids that are not produced tend to accumulate in the hotter reservoir region. Therefore, in some implementations, production from the hotter reservoir region can be momentarily or periodically resumed during the heating process of the colder reservoir region to produce some of that accumulated fluid. Such production can be done via all of the flow control devices underlying the hotter reservoir region, or via selected flow control devices that can be those located in a central position or edge positions below the hotter region. Similarly, production from each of the flow control devices located below the colder reservoir region can be allowed, maintained, or resumed, partially or completely, at different moments in time and during different time intervals independently of the other flow control devices. In particular, the flow control devices can be operated in a dynamic manner to react to various changes observed in the distributed inflow temperature measurements.

Turning now to FIG. 6D, once temperature conformance has improved to a suitable degree, such that the average of the fluid temperatures measured along the production well 24 has increased to a certain value, production of hydrocarbon-containing fluid 80 from the overlying reservoir region which was previously the hotter reservoir region (82A in FIGS. 6A and 6B) can be resumed to enable inflow of hydrocarbon-containing fluid 80 from the entire overlying conformance reservoir region 86. In some implementations, re-opening of the flow control devices 72 located below what was previously the hotter reservoir region can also be done when temperature measurements show that the former hotter reservoir region has cooled below a certain threshold. In other implementations, the reduced flow from the hotter reservoir region can be maintained until an average of the measured temperatures along the colder overlying reservoir region reaches an upper threshold value. In still other implementations, the reduced flow from the hotter reservoir region can be maintained until a level of hydrocarbon-containing fluid in the hotter overlying reservoir region reaches an upper threshold level. Of course, various other criteria can be used in order to decide when production from the hotter reservoir region is to be resumed.

In some implementations, as a result of the improved temperature conformance along the production well 24, the total production from the well in the scenario of FIG. 6D can be increased compared to the total production in the scenario of FIG. 6A. In such scenarios, the increased production along the well 24 results from an increase in the effective well length, that is, the section of the well 24 that is sufficiently hot to provide adequate production rates.

In some implementations, the hydrocarbon recovery process can also include continuously monitoring the inflow temperatures from the overlying conformance reservoir region to identify any additional temperature variations in the inflow temperatures that could lead to the formation of a re-formed hotter overlying reservoir region and a re-formed adjacent colder overlying reservoir region. In such implementations, the hydrocarbon recovery process can also include operating the flow control devices in order to reduce production from the re-formed hotter reservoir region while providing fluid communication and pressure differential between the re-formed colder reservoir region and the production well, in an attempt to cause hot fluids surrounding the re-formed colder reservoir region to be drawn into and heat up the re-formed colder reservoir region.

In some implementations, production from the hotter reservoir region is reduced or stopped, as in FIG. 6B, whenever the hydrocarbon-containing fluid from the hotter overlying reservoir region 82A reaches an upper threshold temperature. The hydrocarbon-containing fluid from the hotter reservoir region 82A can subsequently be allowed to cool to a lower threshold temperature, at which point production from that reservoir region 82A can be resumed or increased again, as in FIG. 6D. In some implementations, the hydrocarbon recovery process therefore allows continuous measurement of the temperature along the production well during production, as well as selective opening and closing of one or more flow control devices to enable targeted sub-cool temperatures, and thus production rates, from different regions of the reservoir. In addition, when there are more than one hotter reservoir regions overlying the production well, the inflow reduction can be conducted at the cooler of the hotter regions (e.g., reservoir region 82B in FIG. 7A) for a shorter amount of time compared to the hottest region (e.g., reservoir region 82A in FIG. 7A). Various timing strategies for modulating inflow through different parts of the well can be implemented.

In some implementations, the upper and lower threshold temperatures can be selected so as to correspond to targeted upper and lower sub-cool temperatures, respectively. In such a case, the targeted upper and lower sub-cool temperatures can be respectively defined as the difference between the steam chamber saturation temperature and the upper and lower threshold temperatures. Therefore, in scenarios where specific values for the upper and lower sub-cool temperatures are desired, the corresponding values for the upper and lower threshold temperatures, which can be monitored through inflow temperature measurements, can depend on the operating reservoir pressure. In some implementations, the upper and lower threshold temperatures can also be selected to maintain a local annulus sub-cool temperature between an inner tubing and a surrounding liner of the well (see, e.g., annulus 66 in FIG. 5) and avoid flashing of the hydrocarbon-containing fluid drawn into the production well.

In some implementations, the upper sub-cool temperature can be between about 1 and about 5 degrees Celsius, while the lower sub-cool temperature can between about 25 and about 50 degrees Celsius. In particular, in some implementations, the upper sub-cool temperature can be selected to provide an upper threshold temperature which is lower than a temperature of steam injected into the injection well, thereby preventing or least mitigating steam breakthrough. In such situations, should inflow temperatures be detected in the hotter reservoir region suggesting steam breakthrough or anticipating steam breakthrough conditions, one or more of the flow control devices below the hotter reservoir region can be partially or completely closed to temporarily reduce or prevent production from the hotter reservoir region.

Figure 7B:
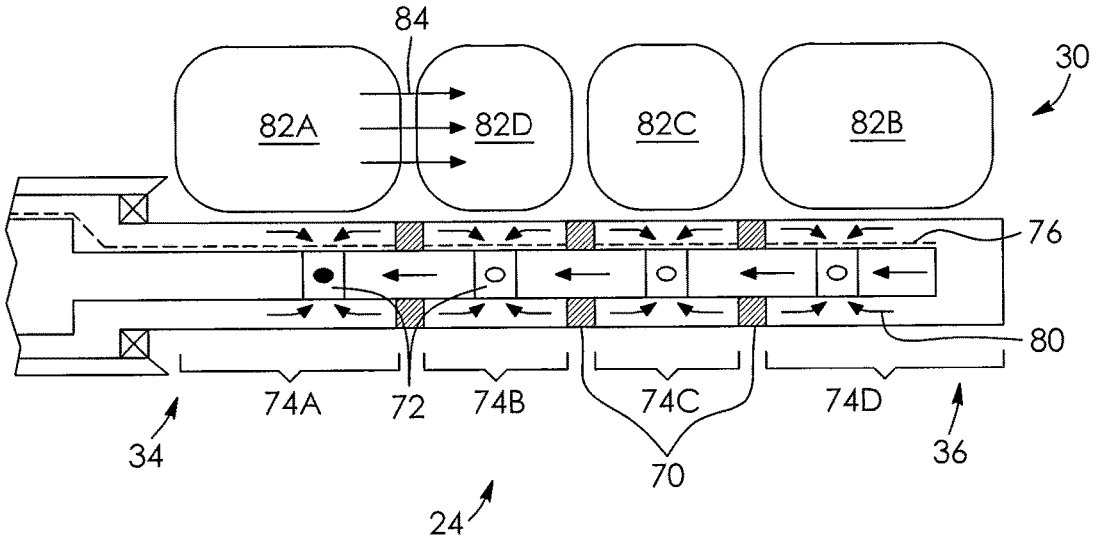
Figure 7C:
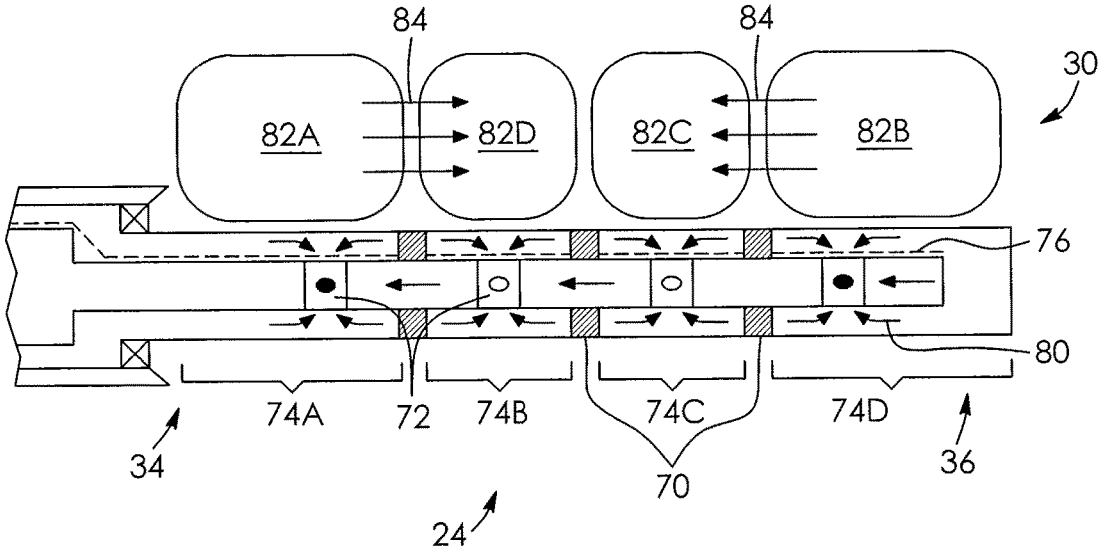
Figure 7D:
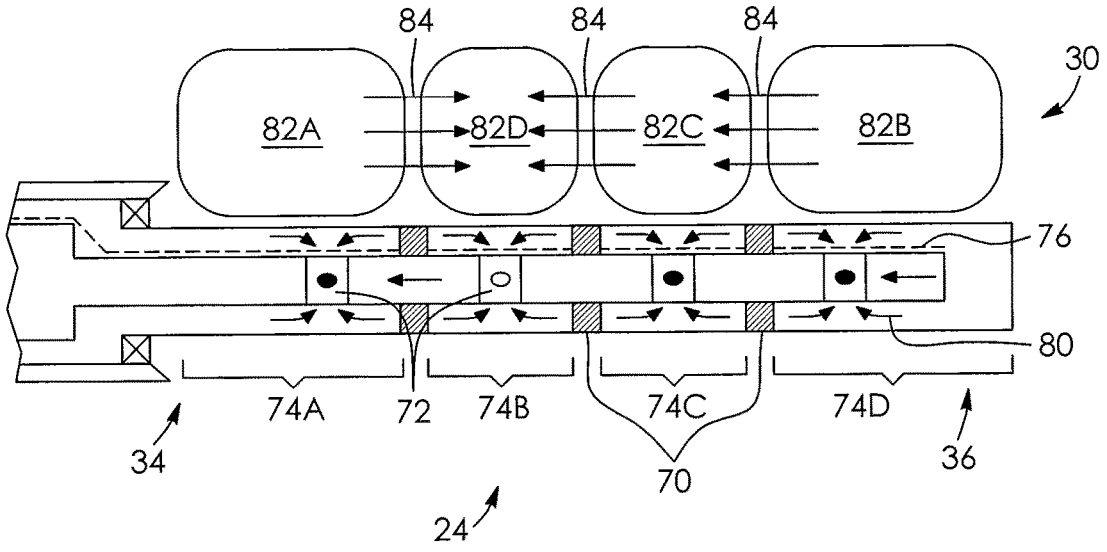

Referring now to FIGS. 7A and 7D, in some implementations, and as mentioned above, the temperature profile along the production well 24 can lead to the identification of more than one hotter and colder overlying reservoir regions, for example two hotter reservoir regions 82A, 82B located respectively at the heel 34 and toe 36 of the production well 24, and two colder reservoir regions 82C, 82D located between the two hotter reservoir regions 82A, 82B. In this scenario, all of the flow control devices 72 are initially open (FIG. 7A). The first flow control device 72 to be closed (partially or completely) is the flow control device 72 associated with the well segment 74A located below the hottest reservoir region 82A (FIG. 7B). The flow control device 72 associated with the well segment 74D located below the second hottest reservoir region 82B (FIG. 7C) may then be closed, followed by the flow control device 72 associated with the well segment 74C located below the third hottest reservoir region 82C (FIG. 7D).

Figure 7E:
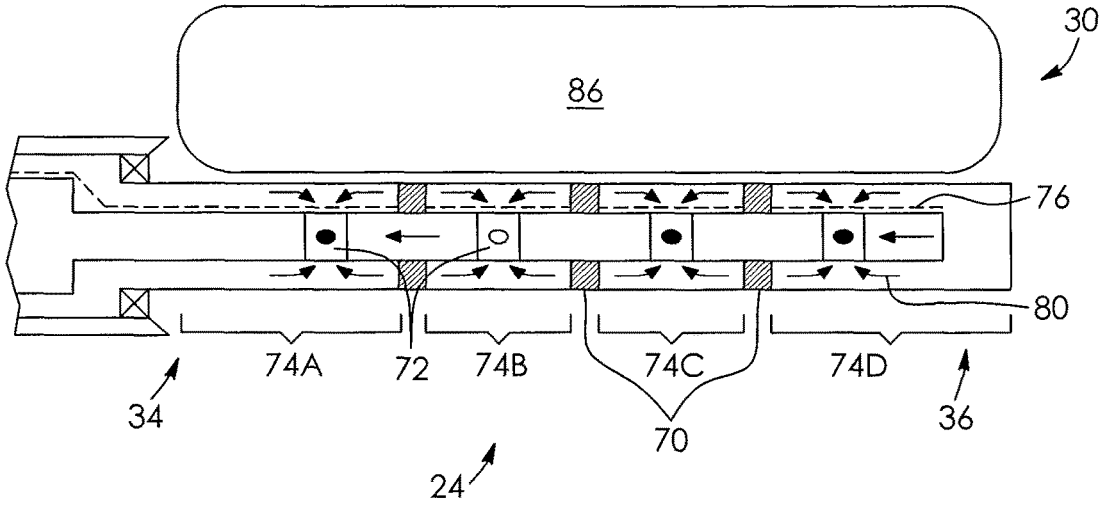
Figure 7F:
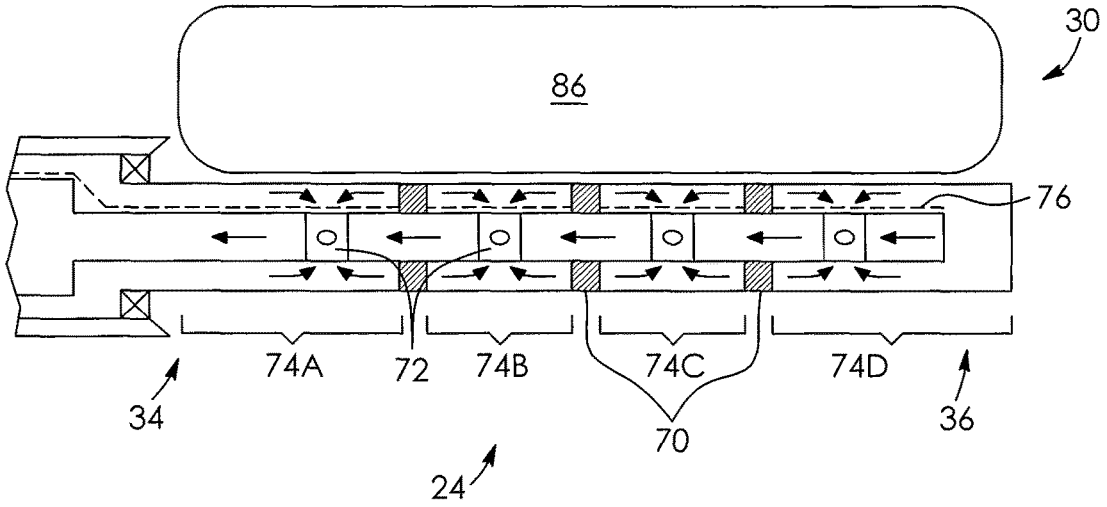

As a result of successively reducing or stopping flow from the hotter reservoir regions, the coldest reservoir region 82D can progressively warm up, thereby facilitating the establishment of an overlying conformance reservoir region 86 having a higher average temperature (FIG. 7E). Alternatively, the flow control devices associated with the two hotter overlying regions 82A and 82B can be modulated to reduce inflow, while the other two well segments can remain open, thereby simultaneously heating both of the cooler overlying regions 82C and 82D. In this regard, FIGS. 7B to 7D illustrate schematically how heat 84 can be transferred from the hotter to colder reservoir regions. As mentioned above, the criteria for opening or closing each flow control device can be based on the inflow temperature measurements and involve temperature thresholds based on targeted sub-cool temperatures. Finally, once overall conformance along the production well 24 has improved to a suitable degree, all of the flow control devices 72 can be re-opened to enable inflow of hydrocarbon-containing fluid 80 from the entire overlying conformance reservoir region 86 (FIG. 7F).

In some implementations, favoring flow of hydrocarbon-containing fluid from the colder overlying reservoir region into the horizontal well can be performed not only by operating flow control devices, but also by managing the pressure drawdown imposed by the pump (or another artificial lift device) on the hydrocarbon-containing fluid entering the production well. For example, when production is limited to the colder reservoir region the pressure drawdown imposed by the pump can be increased in order to increase production rates from the colder reservoir region while the colder reservoir region warms up. In particular, increasing the pressure drawdown imposed by the pump can increase the pressure differential between the colder reservoir and the production well, which in turn can increase the convective forces pulling surrounding hot fluids into the colder reservoir region. As mentioned above, the hot fluids drawn into the colder reservoir region can induce heating and increased production rates from the colder reservoir region.

While production is being limited to the colder reservoir region, there can be a risk of undesired cooling of the hotter reservoir region. In some implementations, the risk can be mitigated by applying higher pressure drawdowns for a short time (as opposed to normal operations with lower pressure drawdowns for a long time) to "catch-up" on production from the hotter reservoir region deferred during the period in which the hotter reservoir region is shut-in to preferentially produce the colder reservoir region. Subsequently, once a suitable degree of temperature conformance has been achieved and production from the former hotter reservoir region has been resumed or increased, the pressure drawdown can be reduced because the hydrocarbon-containing fluids entering the production well from the former colder reservoir region have become warmer and can be produced to surface more easily.

Field Trial on a SAGD Production Well

Some of the techniques described herein were tested on an existing SAGD production well having a completion design as shown in FIG. 5. Initial inflow temperature measurements were performed that indicated that the hottest reservoir region was located above the heel of the well, the second hottest reservoir region was located above the toe of the well, the third hottest reservoir region was adjacent the second hottest reservoir region, and the coldest reservoir region was adjacent the hottest reservoir region. Initial inflow performance relationships (IPRs) were also established to characterize the productivity of each reservoir region and supported the hypothesis that inflow temperature correlates well with productivity, as the hottest reservoir region was the most productive reservoir region, the second hottest reservoir region was the second most productive reservoir region, and so on.

After the initial temperature measurements and IPR testing, flow control devices were operated to focus production from the well segments located below the two colder overlying reservoir regions in an attempt to warm these colder reservoir regions and improve temperature conformance along the well. More specifically, the well was operated for about eight weeks by producing only from the well segments located below the two colder overlying reservoir regions, followed by a two-week "catch-up" interval where production came only from the well segments located below the two hotter overlying reservoir regions.

At the end of the ten-week production period, temperature measurements indicated that temperature conformance had materially improved along the well, as the temperature of the two colder reservoir regions increased without any decrease in the temperature of the two hotter reservoir regions. Updated IPR testing also showed that the productivity index of the coldest and second coldest reservoir regions respectively tripled and more than doubled due to the improved temperature conformance.

Figure 8:
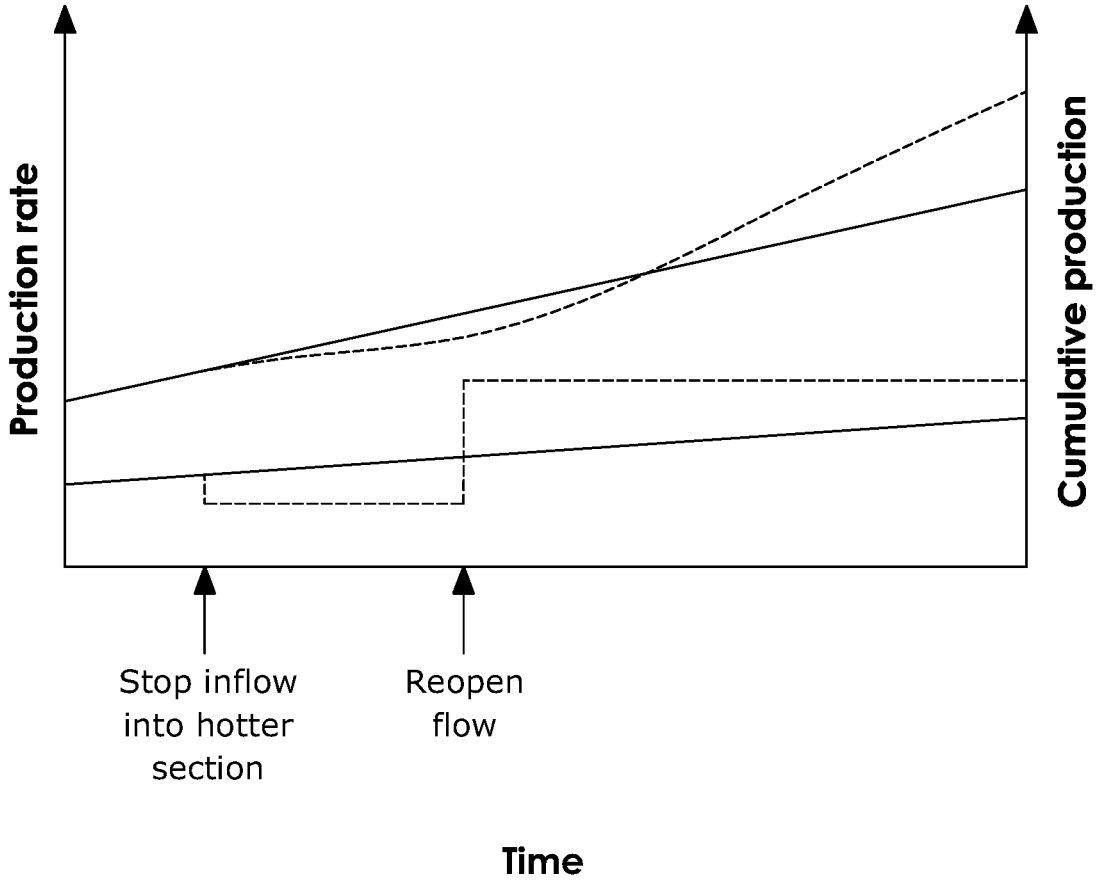
FIG. 8 is a graph of production rate versus time and cumulative production versus time of a production well operated with (dashed curves) without (solid curves) performing flow control operations.

Referring to FIG. 8, in some scenarios while temporary inflow reduction temporarily reduces production rates and the cumulative hydrocarbon production from the well, once the well is returned to regular inflow operation the production rate is immediately enhanced and after a certain amount of time the cumulative hydrocarbon production is also enhanced (dashed curves) compared to a process in which flow control operations are not performed (solid curves).

The invention claimed is:

1. A process for hydrocarbon recovery, comprising:

providing a Steam-Assisted Gravity Drainage (SAGD) well pair in a hydrocarbon-containing reservoir, the well pair including a generally horizontal SAGD injection well overlying a generally horizontal SAGD production well;

identifying a hotter overlying reservoir region and an adjacent colder overlying reservoir region based on measured temperatures of hydrocarbon-containing fluids at a plurality of locations along the horizontal SAGD production well obtained using a plurality of temperature sensors; and operating flow control devices distributed along the horizontal SAGD production well based on the measured temperatures of the hydrocarbon-containing fluids, the operating comprising:

reducing flow of hydrocarbon-containing fluid from the hotter overlying reservoir region into the horizontal SAGD production well, while providing fluid communication and pressure differential between the colder overlying reservoir region and the horizontal SAGD production well, sufficiently to cause hot fluids surrounding the colder overlying reservoir region to be drawn into and induce heating of the colder overlying reservoir region, the step of operating the flow control devices further comprising:

reducing flow of hydrocarbon-containing fluid from the hotter overlying reservoir region when the hydrocarbon-containing fluid from the hotter overlying reservoir region reaches an upper threshold temperature;

allowing the hydrocarbon-containing fluid from the hotter overlying reservoir region to cool to a lower threshold temperature; and then increasing flow of the hydrocarbon-containing fluid from the hotter overlying reservoir region.

2. The process according to claim 1, wherein the hotter overlying reservoir region is located above one of a toe and a heel of the horizontal SAGD production well.

3. The process according to claim 1, further comprising:

partitioning the horizontal SAGD production well into well segments, each well segment being associated with at least one of the flow control devices.

4. The process according to claim 3, wherein the step of partitioning the horizontal SAGD production well into well segments comprises providing isolation devices positioned along the horizontal SAGD production well.

5. The process according to claim 3, wherein the step of operating the flow control devices further comprises:

reducing flow of hydrocarbon-containing fluid from the hotter overlying reservoir region into at least one well segment located below the hotter overlying reservoir region, while providing fluid communication and pressure differential between at least one well segment located below the colder overlying reservoir region and the horizontal SAGD production well.

6. The process according to claim 3, wherein each isolation device is located between two adjacent ones of the flow control devices.

7. The process according to claim 3, wherein the well segments comprise at least three well segments.

8. The process according to claim 3, wherein each well segment has a length of between about 10 and about 500 meters.

9. The process according to claim 1, wherein the plurality of temperature sensors comprises a plurality of distributed fiber-optic temperature sensors positioned along the horizontal SAGD production well.

10. The process according to claim 1, wherein the flow control devices comprise hydraulically actuated valves.

11. The process according to claim 1, wherein the upper threshold temperature and the lower threshold temperature are based on a targeted upper sub-cool temperature and a targeted lower sub-cool temperature, respectively.

12. The process according to claim 1, wherein the upper threshold temperature is lower than a temperature of steam injected into the horizontal SAGD injection well.

13. The process according to claim 1, wherein the step of providing fluid communication and pressure differential between the colder overlying reservoir region and the horizontal SAGD production well is performed at a first pressure drawdown, and wherein the step of increasing the flow of the hydrocarbon-containing fluid from the hotter overlying reservoir region is performed at a second pressure drawdown lower than the first pressure drawdown.

14. The process according to claim 1, wherein the step of operating the flow control devices comprises operating the flow control devices located below the colder overlying reservoir region in an open position.

15. The process according to claim 1, wherein the step of operating the flow control devices comprises impeding flow from the hotter overlying reservoir region into the horizontal SAGD production well while enabling a lower flow rate through the flow control devices.

16. A process for hydrocarbon recovery, comprising:

providing a Steam-Assisted Gravity Drainage (SAGD) well pair in a hydrocarbon-containing reservoir, the well pair including a generally horizontal SAGD injection well overlying a generally horizontal SAGD production well;

identifying a hotter overlying reservoir region and an adjacent colder overlying reservoir region based on measured temperatures of hydrocarbon-containing fluids at a plurality of locations along the horizontal SAGD production well obtained using a plurality of temperature sensors; and operating flow control devices distributed along the horizontal SAGD production well based on the measured temperatures of the hydrocarbon-containing fluids, the operating comprising:

reducing flow of hydrocarbon-containing fluid from the hotter overlying reservoir region into the horizontal SAGD production well, while providing fluid communication and pressure differential between the colder overlying reservoir region and the horizontal SAGD production well, sufficiently to cause hot fluids surrounding the colder overlying reservoir region to be drawn into and induce heating of the colder overlying reservoir region, the step of operating the flow control devices further comprising at least one of:

maintaining a reduced flow of hydrocarbon-containing fluid from the hotter overlying reservoir region into the horizontal SAGD production well until a level of hydrocarbon-containing fluid in the hotter overlying reservoir region reaches an upper threshold level; and then increasing flow of the hydrocarbon-containing fluid from the hotter overlying reservoir region;

maintaining a reduced flow of hydrocarbon-containing fluid from the hotter overlying reservoir region into the horizontal SAGD production well until an average of the measured temperatures along the colder overlying reservoir region reaches an upper threshold value; and then increasing flow of the hydrocarbon-containing fluid from the hotter overlying reservoir region; and maintaining a reduced flow of hydrocarbon-containing fluid from the hotter overlying reservoir region into the horizontal SAGD production well until a variance of the measured temperatures along the horizontal SAGD production well relative to a maximum measured temperature reaches a lower threshold variance, such that the hotter and colder overlying reservoir regions together form an overlying conformance reservoir region; and then increasing flow of the hydrocarbon-containing fluid from the former hotter overlying reservoir region.

17. The process according to claim 16, further comprising:

partitioning the horizontal SAGD production well into well segments, each well segment being associated with at least one of the flow control devices.

18. The process according to claim 17, wherein the step of partitioning the horizontal SAGD production well into well segments comprises providing isolation devices positioned along the horizontal SAGD production well.

19. The process according to claim 17, wherein the step of operating the flow control devices further comprises:

reducing flow of hydrocarbon-containing fluid from the hotter overlying reservoir region into at least one well segment located below the hotter overlying reservoir region, while providing fluid communication and pressure differential between at least one well segment located below the colder overlying reservoir region and the horizontal SAGD production well.

20. A process for hydrocarbon recovery, comprising:

providing a Steam-Assisted Gravity Drainage (SAGD) well pair in a hydrocarbon-containing reservoir, the well pair including a generally horizontal SAGD injection well overlying a generally horizontal SAGD production well;

identifying a hotter overlying reservoir region and an adjacent colder overlying reservoir region based on measured temperatures of hydrocarbon-containing fluids at a plurality of locations along the horizontal SAGD production well obtained using a plurality of temperature sensors; and operating flow control devices distributed along the horizontal SAGD production well based on the measured temperatures of the hydrocarbon-containing fluids, the operating comprising:

reducing flow of hydrocarbon-containing fluid from the hotter overlying reservoir region into the horizontal SAGD production well, while providing fluid communication and pressure differential between the colder overlying reservoir region and the horizontal SAGD production well, sufficiently to cause hot fluids surrounding the colder overlying reservoir region to be drawn into and induce heating of the colder overlying reservoir region, the step of operating the flow control devices further comprising reducing flow of hydrocarbon-containing fluid into the flow control device located below the colder overlying reservoir region that is closest to the hotter overlying reservoir region once the hydrocarbon-containing fluids at the flow control device closest to the hotter overlying reservoir region reach an upper fluid temperature.

21. The process according to claim 20, wherein the step of operating the flow control devices further comprises sequentially reducing flow of hydrocarbon-containing fluid through a series of flow control devices located below the colder overlying reservoir region, starting from the flow control device that is the closest to the hotter overlying reservoir region, once the hydrocarbon-containing fluids at each flow control device in the series sequentially reach an upper fluid temperature.

22. The process according to claim 20, further comprising:

partitioning the horizontal SAGD production well into well segments, each well segment being associated with at least one of the flow control devices.

23. The process according to claim 22, wherein the step of partitioning the horizontal SAGD production well into well segments comprises providing isolation devices positioned along the horizontal SAGD production well.

24. The process according to claim 22, wherein the step of operating the flow control devices further comprises:

reducing flow of hydrocarbon-containing fluid from the hotter overlying reservoir region into at least one well segment located below the hotter overlying reservoir region, while providing fluid communication and pressure differential between at least one well segment located below the colder overlying reservoir region and the horizontal SAGD production well.

25. A process for hydrocarbon recovery using a generally horizontal well located in a hydrocarbon-containing reservoir, comprising:

operating flow control devices distributed along the horizontal well based on temperatures of hydrocarbon-containing fluids at a plurality of locations along the horizontal well, the temperatures of hydrocarbon-containing fluids indicating a presence of a hotter overlying reservoir region and an adjacent colder overlying reservoir region in the hydrocarbon-containing reservoir, the operating comprising:

reducing flow of hydrocarbon-containing fluid from the hotter overlying reservoir region into the horizontal well, while providing fluid communication and pressure differential between the colder overlying reservoir region and the production well, sufficiently to cause hot fluids surrounding the colder overlying reservoir region to be drawn into and induce heating of the colder overlying reservoir region, the step of operating the flow control devices further comprising:

reducing flow of hydrocarbon-containing fluid from the hotter overlying reservoir region when the hydrocarbon-containing fluid from the hotter overlying reservoir region reaches an upper threshold temperature;

allowing the hydrocarbon-containing fluid from the hotter overlying reservoir region to cool to a lower threshold temperature; and then increasing flow of the hydrocarbon-containing fluid from the hotter overlying reservoir region.

26. The process according to claim 25, further comprising:

partitioning the horizontal well into well segments.

27. The process according to claim 26, wherein the step of operating the flow control devices further comprises:

reducing flow of hydrocarbon-containing fluid from the hotter overlying reservoir region into at least one well segment located below the hotter overlying reservoir region, while providing fluid communication and pressure differential between at least one well segment located below the colder overlying reservoir region and the horizontal well.

28. The process according to claim 25, further comprising:

measuring the temperatures of hydrocarbon-containing fluids at the plurality of locations along the horizontal well using a plurality of temperature sensors in order to identify the hotter overlying reservoir region and the adjacent colder overlying reservoir region.

29. A process for hydrocarbon recovery using a generally horizontal well located in a hydrocarbon-containing reservoir, comprising:

operating flow control devices distributed along the horizontal well based on temperatures of hydrocarbon-containing fluids at a plurality of locations along the horizontal well, the temperatures of hydrocarbon-containing fluids indicating the presence of a hotter overlying reservoir region and an adjacent colder overlying reservoir region in the hydrocarbon-containing reservoir, the operating comprising:

reducing flow of hydrocarbon-containing fluid from the hotter overlying reservoir region into the horizontal well while providing fluid communication and pressure differential between the colder overlying reservoir region and the horizontal well at a first pressure drawdown, sufficiently to cause hot fluids surrounding the colder overlying reservoir region to be drawn into and induce heating of the colder overlying reservoir region; and then drawing hydrocarbon-containing fluid from the hotter overlying reservoir region into the horizontal well at second pressure drawdown lower than the first pressure drawdown while reducing flow of the hydrocarbon-containing fluid from the colder overlying reservoir region into the horizontal well.

30. The process according to claim 29, wherein the horizontal well is one of: part of a Steam-Assisted Gravity Drainage (SAGD) well pair including an overlying SAGD injection well; an infill well located in between two SAGD well pairs; and a step-out well located beside an adjacent SAGD well pair.

31. A process for hydrocarbon recovery using a generally horizontal well located in a hydrocarbon-containing reservoir, comprising:

operating flow control devices distributed along the horizontal well based on temperatures of hydrocarbon-containing fluids at a plurality of locations along the horizontal well, the temperatures of hydrocarbon-containing fluids indicating a presence of a hotter overlying reservoir region and an adjacent colder overlying reservoir region in the hydrocarbon-containing reservoir, the operating comprising:

reducing flow of hydrocarbon-containing fluid from the hotter overlying reservoir region into the horizontal well, while providing fluid communication and pressure differential between the colder overlying reservoir region and the production well, sufficiently to cause hot fluids surrounding the colder overlying reservoir region to be drawn into and induce heating of the colder overlying reservoir region, the step of operating the flow control devices further comprising at least one of:

maintaining a reduced flow of hydrocarbon-containing fluid from the hotter overlying reservoir region into the horizontal SAGD production well until a level of hydrocarbon-containing fluid in the hotter overlying reservoir region reaches an upper threshold level; and then increasing flow of the hydrocarbon-containing fluid from the hotter overlying reservoir region;

maintaining a reduced flow of hydrocarbon-containing fluid from the hotter overlying reservoir region into the horizontal SAGD production well until an average of the measured temperatures along the colder overlying reservoir region reaches an upper threshold value; and then increasing flow of the hydrocarbon-containing fluid from the hotter overlying reservoir region; and maintaining a reduced flow of hydrocarbon-containing fluid from the hotter overlying reservoir region into the horizontal SAGD production well until a variance of the measured temperatures along the horizontal SAGD production well relative to a maximum measured temperature reaches a lower threshold variance, such that the hotter and colder overlying reservoir regions together form an overlying conformance reservoir region; and then increasing flow of the hydrocarbon-containing fluid from the former hotter overlying reservoir region.

32. The process according to claim 31, further comprising:

partitioning the horizontal well into well segments.

33. The process according to claim 32, wherein the step of operating the flow control devices further comprises:

reducing flow of hydrocarbon-containing fluid from the hotter overlying reservoir region into at least one well segment located below the hotter overlying reservoir region, while providing fluid communication and pressure differential between at least one well segment located below the colder overlying reservoir region and the horizontal well.

34. The process according to claim 32, further comprising:

measuring the temperatures of hydrocarbon-containing fluids at the plurality of locations along the horizontal well using a plurality of temperature sensors in order to identify the hotter overlying reservoir region and the adjacent colder overlying reservoir region.

35. A process for hydrocarbon recovery using a generally horizontal well located in a hydrocarbon-containing reservoir, comprising:

operating flow control devices distributed along the horizontal well based on temperatures of hydrocarbon-containing fluids at a plurality of locations along the horizontal well, the temperatures of hydrocarbon-containing fluids indicating a presence of a hotter overlying reservoir region and an adjacent colder overlying reservoir region in the hydrocarbon-containing reservoir, the operating comprising:

reducing flow of hydrocarbon-containing fluid from the hotter overlying reservoir region into the horizontal well, while providing fluid communication and pressure differential between the colder overlying reservoir region and the production well, sufficiently to cause hot fluids surrounding the colder overlying reservoir region to be drawn into and induce heating of the colder overlying reservoir region, the step of operating the flow control devices further comprising reducing flow of hydrocarbon-containing fluid into the flow control device located below the colder overlying reservoir region that is closest to the hotter overlying reservoir region once the hydrocarbon-containing fluids at the flow control device closest to the hotter overlying reservoir region reach an upper fluid temperature.

36. The process according to claim 35, wherein the step of operating the flow control devices further comprises sequentially reducing flow of hydrocarbon-containing fluid through a series of flow control devices located below the colder overlying reservoir region, starting from the flow control device that is the closest to the hotter overlying reservoir region, once the hydrocarbon-containing fluids at each flow control device in the series sequentially reach an upper fluid temperature.

37. The process according to claim 36, wherein the step of operating the flow control devices further comprises:

reducing flow of hydrocarbon-containing fluid from the hotter overlying reservoir region into at least one well segment located below the hotter overlying reservoir region, while providing fluid communication and pressure differential between at least one well segment located below the colder overlying reservoir region and the horizontal well.

38. The process according to claim 36, further comprising:

measuring the temperatures of hydrocarbon-containing fluids at the plurality of locations along the horizontal well using a plurality of temperature sensors in order to identify the hotter overlying reservoir region and the adjacent colder overlying reservoir region.

39. The process according to claim 35, further comprising:

partitioning the horizontal well into well segments.

* * * * *